US005697234A

United States Patent [19]

Lozier et al.

[11] Patent Number: 5,697,234

[45] Date of Patent: Dec. 16, 1997

[54] MULTIPLE LOCK ASSEMBLY

[75] Inventors: Benjamin F. Lozier, Louisville; Karl A. Hermann, Canton; Custodio M. Fabella, Jr., North Canton, all of Ohio

[73] Assignee: Diebold, Incorporated, Canton, Ohio

[21] Appl. No.: 747,309

[22] Filed: Nov. 12, 1996

Related U.S. Application Data

[62] Division of Ser. No. 242,909, May 13, 1994, Pat. No. 5,603,234.

[51] Int. Cl.[6] ..... E05B 63/14

[52] U.S. Cl. ..... 70/119; 70/120; 292/36

[58] Field of Search ..... 70/118–120, 130, 70/134; 109/59 R; 292/3, 32–37, 336.3

[56] References Cited

U.S. PATENT DOCUMENTS

| | | | |
|---|---|---|---|
| 2,094,369 | 9/1937 | Millice | 70/118 |
| 2,375,196 | 5/1945 | Cederwall | 70/118 |
| 2,445,511 | 7/1948 | Claveria | 70/119 |
| 2,494,575 | 1/1950 | O'Brien | 70/119 |
| 2,729,089 | 1/1956 | Pelcin | 70/151 |
| 4,147,044 | 4/1979 | Bernath | 70/119 |
| 4,362,034 | 12/1982 | Amgar | 70/108 |
| 4,470,277 | 9/1984 | Uyeda | 70/118 |
| 4,665,727 | 5/1987 | Uyeda | 70/279 |
| 4,679,415 | 7/1987 | Spratt | 70/118 |
| 4,714,030 | 12/1987 | Cole | 109/61 |
| 4,850,623 | 7/1989 | Franklin et al. | 292/144 |
| 4,917,022 | 4/1990 | Ogasawara et al. | 109/43 |
| 5,067,755 | 11/1991 | James | 292/33 |
| 5,341,752 | 8/1994 | Hambleton | 109/59 R |
| 5,603,234 | 2/1997 | Lozier et al. | 70/119 |

FOREIGN PATENT DOCUMENTS

| | | |
|---|---|---|
| 2 119 011 | of 0000 | United Kingdom . |
| 2 089 422 | 6/1982 | United Kingdom . |
| 2 146 689 | 4/1985 | United Kingdom . |

*Primary Examiner*—Suzanne Dino

*Attorney, Agent, or Firm*—D. Peter Hochberg; Mark Kusner

[57] ABSTRACT

A lock assembly for locking and unlocking a door comprising a lock bar moveable between a locked and unlocked position, three locks, each of which have lock arms moveable between a locked and an unlocked position, and a linkage connecting the lock arms to the lock bar. The linkage has a first operating configuration whereby the lock bar moves from its locked to its unlocked position in response to the movement of any pair of lock arms from their locked to their unlocked position. The linkage also has a second operating configuration whereby the lock bar moves from its locked to its unlocked position in response to either movement by a predetermined pair of lock arms from their locked to unlocked position or the movement of the third lock arm from its locked to unlocked position.

5 Claims, 21 Drawing Sheets

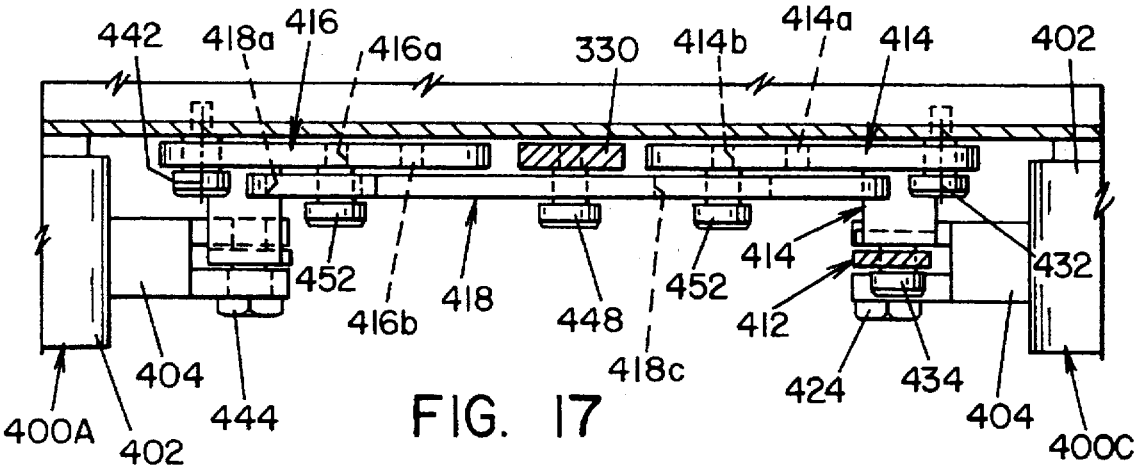
FIG. 17
FIG. 18
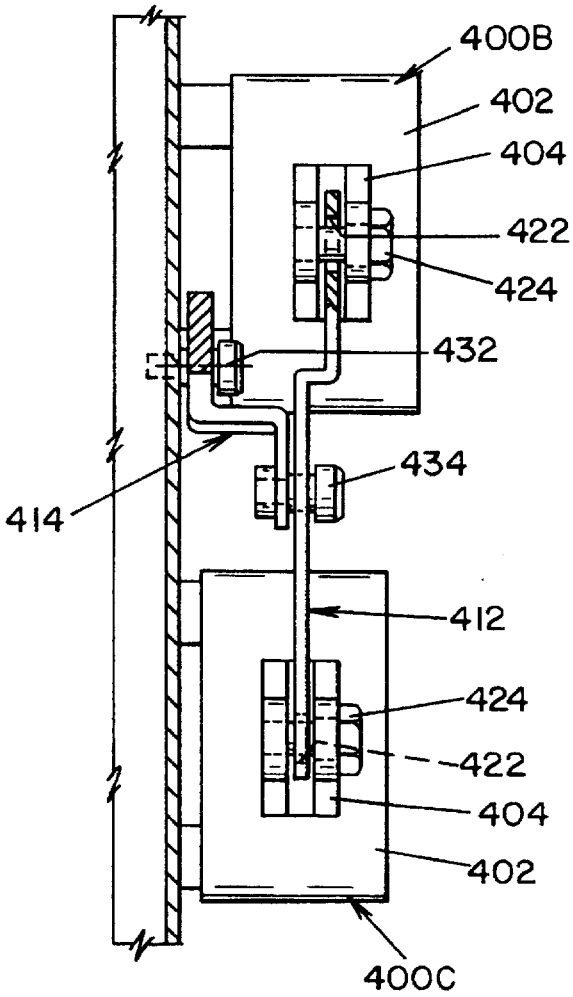

MULTIPLE LOCK ASSEMBLY

This is a divisional of application Ser. No. 08/242,909 filed on May 13, 1994 now U.S. Pat. No. 5,603,234.

FIELD OF THE INVENTION

The present invention relates generally to locking mechanisms, and more particularly to a multiple lock assembly for use on vault doors.

BACKGROUND OF THE INVENTION

Vaults are commonly used in banks and financial institutions to provide for safe reposit of money, documents and valuables. Many vault doors typically include a locking mechanism having two locks, which mechanism may be configured to open when one lock alone, or both locks together, are opened. A dual lock assembly which can be opened by opening one of the locks provides additional convenience in the event one lock fails by allowing access to the vault through use of the other lock; but does not provide additional security over a single lock assembly with respect to unauthorized entry into the vault. A dual lock assembly configured to require both locks be opened to open the assembly provides the additional security not provided by the foregoing one lock arrangement, but creates a problem in that if one of the locks fail, access to the vault is denied. For this reason vaults with doors utilizing a dual locking mechanism that require both locks be open sometimes also include a small emergency access opening (emergency door) in some inconvenient, not easily accessible section of the vault to permit access in the event of a lock failure. As can be appreciated, this feature detracts from the security of the vault.

It is also known to provide vault doors with locking mechanisms which include four locks. Such four lock mechanisms are commonly used in Federal Reserve Banks for additional security. The four locks are mechanically arranged such that opening any two of the locks will open the vault door. With such an arrangement, if one or two of the four locks fails, the vault can still be opened, since the remaining two locks can be opened. One of the problems with the four-lock arrangement is that it is complex and relatively expensive to build. Another problem is that the arrangement lacks versatility because the locks function in only one manner to open the vault door.

Further, none of the aforemenentioned lock assemblies provides an assembly for use in a situation wherein it may be desirable for security reasons to have a dual lock arrangement that requires two separate locks on a vault door be opened (preferably by two separate individuals) to gain access to a vault, but at the same time allows access to the vault to a single individual, such as an employer or supervisor, by opening a single lock.

The present invention overcomes these and other problems and provides a three-lock assembly for a security door, which lock assembly has a first configuration wherein unlocking any two of the locks will unlock the assembly, and a second configuration wherein two specific locks of the three locks must be unlocked to unlock the assembly, the remaining lock being a master lock and alone able to unlock the assembly.

SUMMARY OF INVENTION

In accordance with the present invention there is provided a lock assembly for locking and unlocking a security door comprising a lock bar, which is movable a predetermined distance between a first position locking the door and a second position unlocking the door, and three spaced-apart locks. Each of the locks includes a lock arm movable a set distance between a locked position and an unlocked position. A first link is connected at one end to the lock arm of a first of the locks and is connected at the other end to the lock arm of a second of the locks. A second link is connected at one end to the first link and connected at the other end to the lock arm of a third of the locks and connection means are provided for connecting the second link to the lock bar. The first and second links are dimensioned such that movement of the lock arms of any two of the three locks from the locked position to the unlocked position causes the lock bar to move from the first position to the second position.

In accordance with another aspect of the present invention, there is provided a lock assembly for locking and unlocking a security door comprising a lock bar, which is movable a predetermined distance between a first position locking the door and a second position unlocking the door, and three spaced-apart locks. Each of the locks includes a lock arm movable a set distance between a locked position and an unlocked position. A first link is connected at one end to the lock arm of a first of the three locks and connected at the other end to the lock arm of a second of the three locks. A second link is connected at one end to the first link and connected at the other end to the lock arm of a third of the three locks. Connection means are provided for connecting the second link to the lock bar. The connection means and the first and second links are dimensioned such that movement of the lock arms of a predetermined pair of locks will cause said lock bar to move from the first position to the second position, and movement of the lock arm of a predetermined third lock will cause the lock bar to move from the first position to the second position.

In accordance with another aspect of the present invention, there is provided a lock assembly for locking and unlocking a security door comprising a lock bar, which is movable a predetermined distance between a locked and an unlocked position, and at least three spaced-apart locks. Each of the locks has a lock arm movable a predetermined distance between a locked position and an unlocked position. A linkage connects the lock arms to the lock bar, the linkage having a first configuration and a second configuration. In its first configuration, movement of the lock arms of any two of the locks moves the lock bar to the unlocked position. In its second configuration, the movement of the lock arms of a predetermined pair of the locks or the movement of the lock arm of a third predetermined lock moves the lock bar to the unlocked position.

In accordance with another aspect of the present invention, there is provided a lock assembly for use on a security door for locking and unlocking the same. The lock assembly comprised of a lock component movable a predetermined distance between a first position locking the door and a second position unlocking the door; and there spaced-apart locks. Each of the locks has a lock arm movable a specific distance between a locked position and an unlocked position. A linkage connects the locks to the lock component to cause movement of the lock component in response to movement of each of the lock arms. The linkage is comprised of plurality of linkage members which are interconnected by pins for relative motion. The linkage has a first pin location and a second pin location, wherein when a connecting pin is in the first pin location the linkage assumes a first operating configuration and when the connecting pin is in the second pin location, the linkage assumes a second operating configuration. When in the first operating configuration, movement of the lock arms of any two of the three locks from the locked position to the unlocked position causes the linkage to move the lock components to the second position, and when in the second operating configuration, movement of the lock arms of a specific two of the three locks for movement of the lock arm of the remaining of the three locks causes the linkage to move the lock component to the second position.

It is an object of the present invention to eliminate the problems in the prior art and to provide a multi-lock mechanism which provides maximum security while permitting access to the vault interior should one of the locks fail.

It is an object of the present invention to provide a lock assembly for securing vault doors, which lock assembly includes a plurality of interconnected locks.

It is another object of the present invention to provide a lock assembly as described above having three locks which may be easily and quickly modified to have two distinct operating configurations.

It is another object of the present invention to provide a lock assembly as described above wherein in a first operating configuration unlocking any two of the three locks will open the lock assembly.

It is a further object of the present invention to provide a lock assembly wherein in a second operating configuration unlocking two specific locks, or unlocking the third remaining lock alone, will open the lock assembly.

A still further object of the present invention is to provide a lock assembly as described above which may be opened even in the event of failure of one of the locks.

Another object of the present invention is to provide a locking assembly as described above which offers high security.

Another object of the present invention is to provide a locking assembly that is relatively inexpensive to manufacture and can be quickly and easily modified to the first or second operating configuration.

These and other objects and advantages will become apparent from the following description of preferred embodiments of the invention taken together with the accompanying drawings.

DRAWINGS

The invention may take form in certain parts and arrangements of parts, preferred embodiments of which will be described in detail in the specification and illustrated in the accompanying drawings wherein:

FIG. 17 is a sectional view taken along line 17—17 of FIG. 16A;

FIG. 18 is a sectional view taken along line 18—18 of FIG. 16A;

DETAILED DESCRIPTION OF PREFERRED EMBODIMENT

Figure 1:
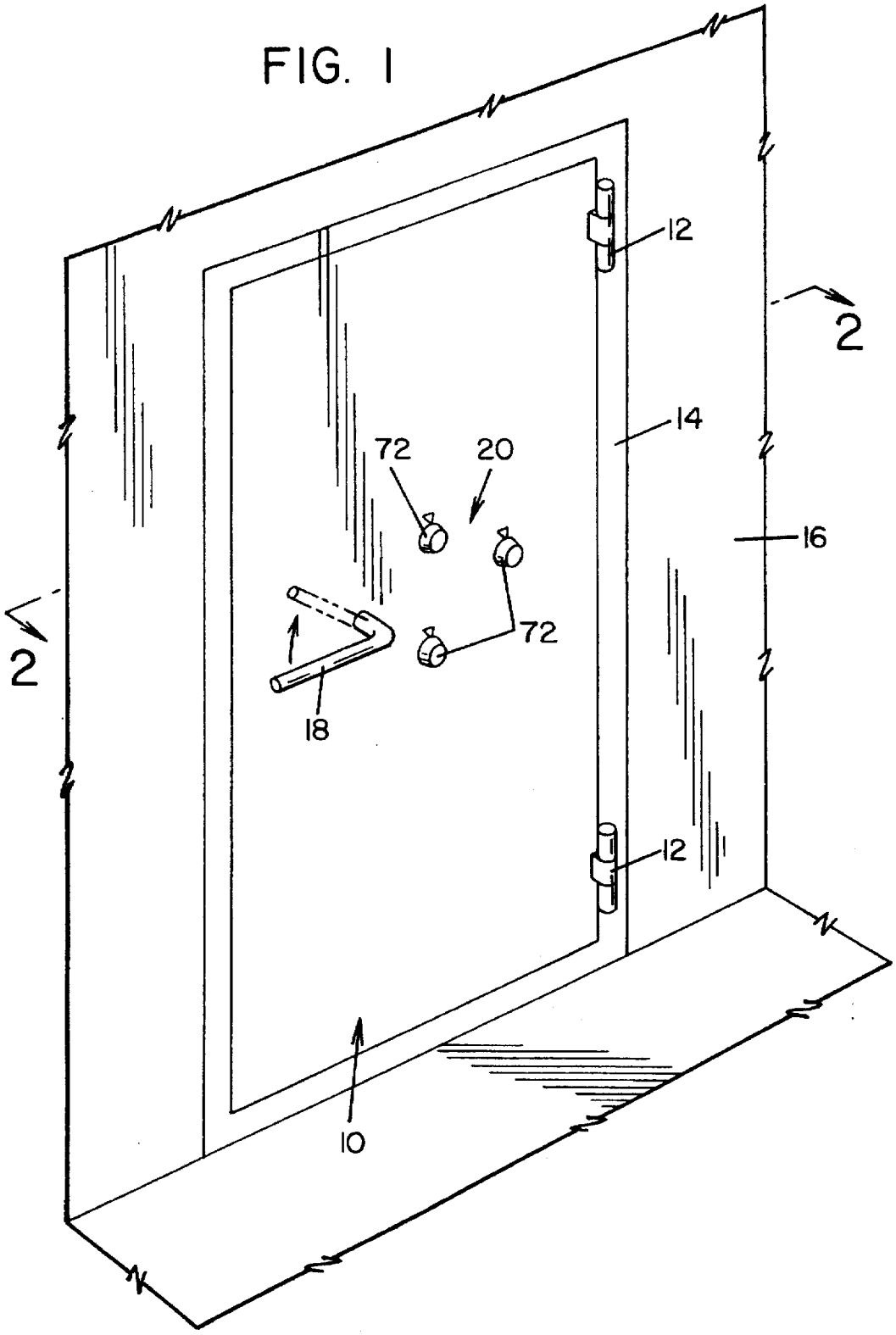
FIG. 1 is a perspective front view of a vault door containing a locking assembly according to a preferred embodiment of the present invention.

Referring now to the drawings where the showing is for the purpose of illustrating a preferred embodiment of the invention and not for purpose of limiting same, FIG. 1 is a perspective front view of a vault door 10 incorporating a multiple lock assembly 20 according to the present invention. Door 10 is mounted on hinges 12 to a door frame 14 which is formed or cast within vault a wall 16 in a conventionally known manner. A handle 18 is provided together with a lock assembly 20 to open (i.e., release) vault door 10 as will be described in greater detail below.

Figure 2:
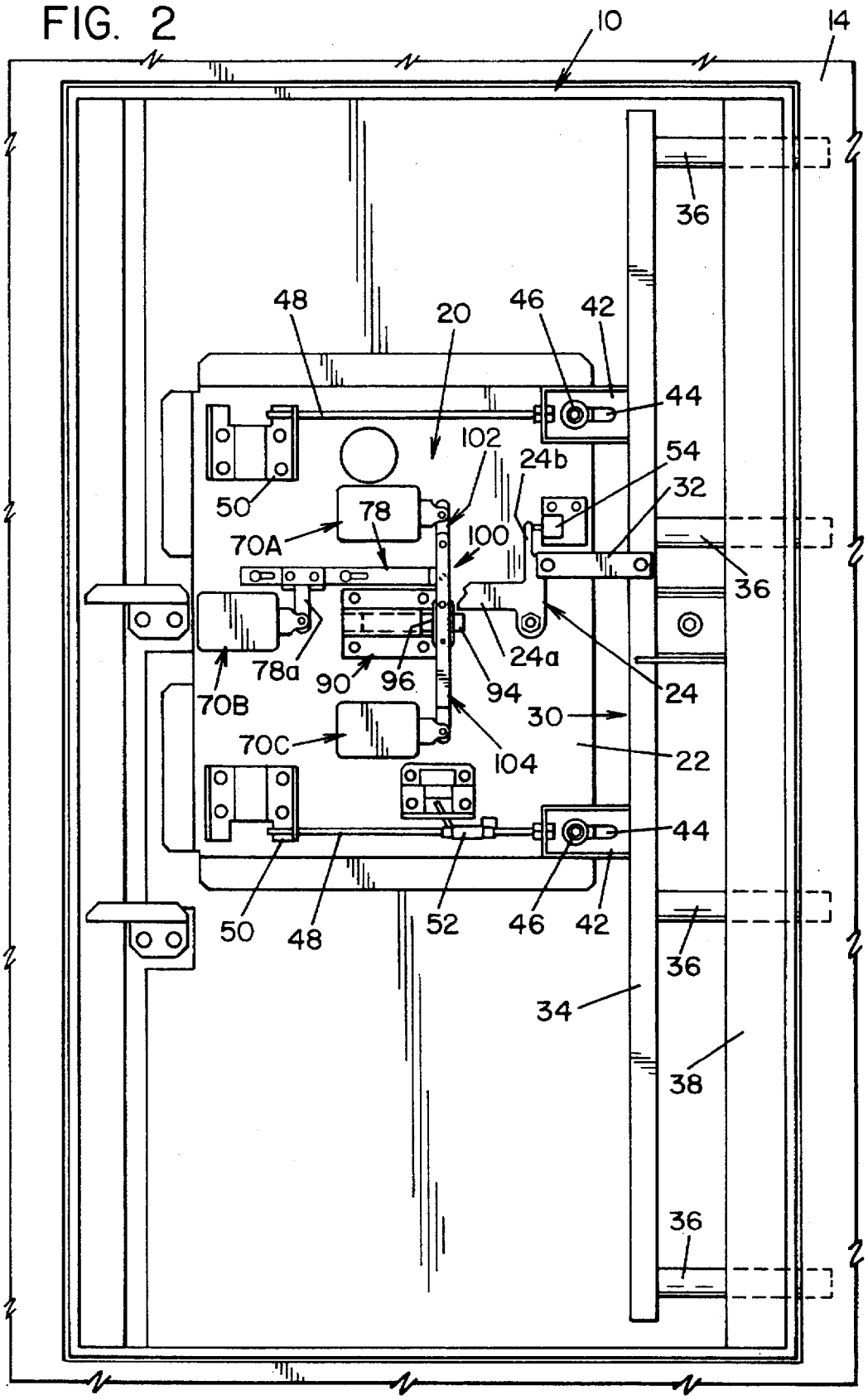
FIG. 2 is a sectional elevational view of the vault door, taken along line 2—2 of FIG. 1, showing the locking assembly.

Referring now to FIG. 2, the internal components of door 10 are shown from the rear or back side of door 10. Door 10 includes a lock assembly platform 22 on which lock assembly 20 is mounted. A locking cam 24 is mounted to handle 18 for rotation therewith. Locking cam 24 includes a first arm **24*a* for operable engagement with lock assembly 20, and a second arm 24*b* which is connected to vault works 30. Vault works 30 includes a connector plate 32 which is pinned at one end to arm 24*b* of locking cam 24, and is pinned at the other end to a bolt bar 34. A plurality of locking bolts 36 extend from one side of bolt bar 34 through a re-enforcing beam 38 provided along the inner edge of vault door 10. A plurality of recesses formed in door frame 14 are provided to be in registry with locking bolts 36 and receive same therein when the vault door 10 is in its locked position. A pair of brackets 42 extend from the other side of bolt bar 34. Each bracket 42 includes an elongated slot 44 which is dimensioned to receive a pin or bolt 46. Slots 44 are parallel to the axis of lock bolts 36 to facilitate movement of bolt bar 34 along an axis which is generally parallel to the axes of locking bolts 36. Guide rods 48 are mechanically attached to one end of brackets 42 and extend from brackets 42 through apertures in secondary brackets 50. Limit switches 52, 54** may be provided to monitor the operation and/or relative position of the respective door components.

The components heretofore described are typically found in many vault doors in similar arrangements, and in and of themselves form no part of the present invention. They have been described to illustrate the typical vault or safe components with which the present invention is utilized.

Figure 3:
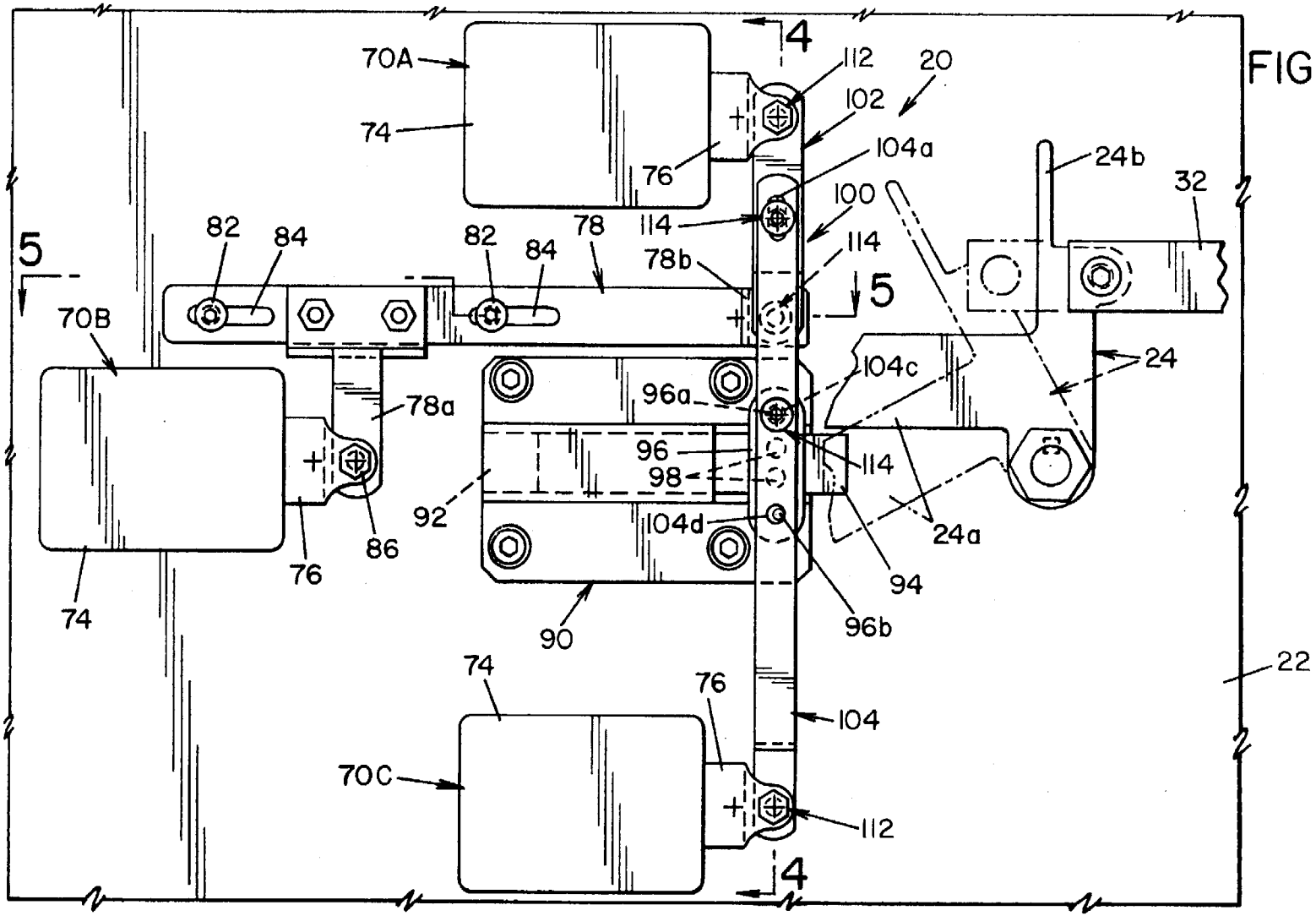
FIG. 3 is an enlarged elevational view of the locking assembly shown in FIG. 2.

Referring now to FIG. 3, lock assembly 20 is best seen. Lock assembly 20 is comprised of three spaced apart locks designated 70A, 70B and 70C in the drawings. In the embodiment shown, locks 70A, 70B and 70C are generally identical and are conventionally known mechanical combination locks each having a numerical dial 72 respectively (best seen in FIG. 1) located on the front of vault door 10.

Figure 5:
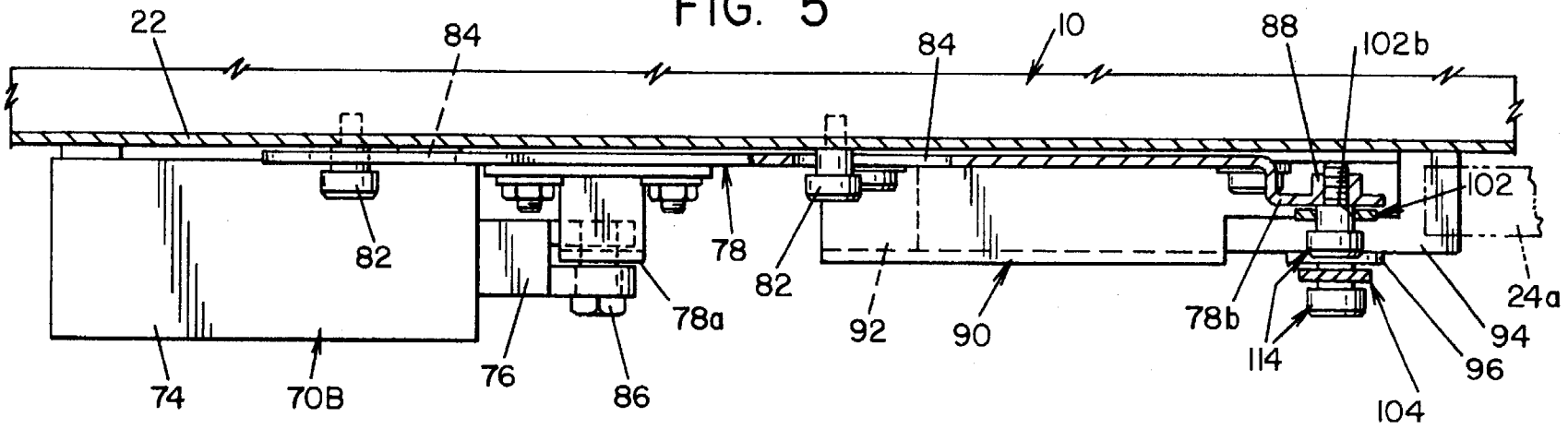
FIG. 5 is a sectional view taken along line 5—5 of FIG. 3.

Each lock 70A, 70B, 70C has a lock housing 74, and a lock arm 76 which extends therefrom. Each lock arm 76 is movable between an extended position (as best shown in FIG. 3) and a retracted position (as best seen in FIGS. 6–14). In the embodiment shown, locks 70A, 70B, 70C are arranged in a generally triangular configuration such that lock arms 76 are generally parallel to each other and Facing the same direction. An extension arm 78, having a laterally extending bracket 78*a* fastened thereto, is mounted to lock platform 22 by means of guide pins 82 extending through elongated slots 84 in extension arm 78. Slots 84 are aligned to allow movement of extension arm 78 in a direction generally parallel to the direction of movement of lock arms 76 of locks 70A, 70B, 70C. A conventional fastener 86 secures lock arm 76 of lock 70B to bracket 78*a* of extension arm 78. In this respect, movement of lock arm 76 of lock 70B is translated into linear motion of bracket 78*a* and hence, extension arm 78. As best seen in FIG. 3, extension arm 78 is dimensioned to have a free end designated 78*b* in the drawings, which is generally aligned with lock arms 76 of locks 70A and 70C. Free end 78*b* of extension arm 78 is offset from the general plane of extension arm 78 and includes a threaded boss 88 as best seen in FIG. 5.

Figure 4:
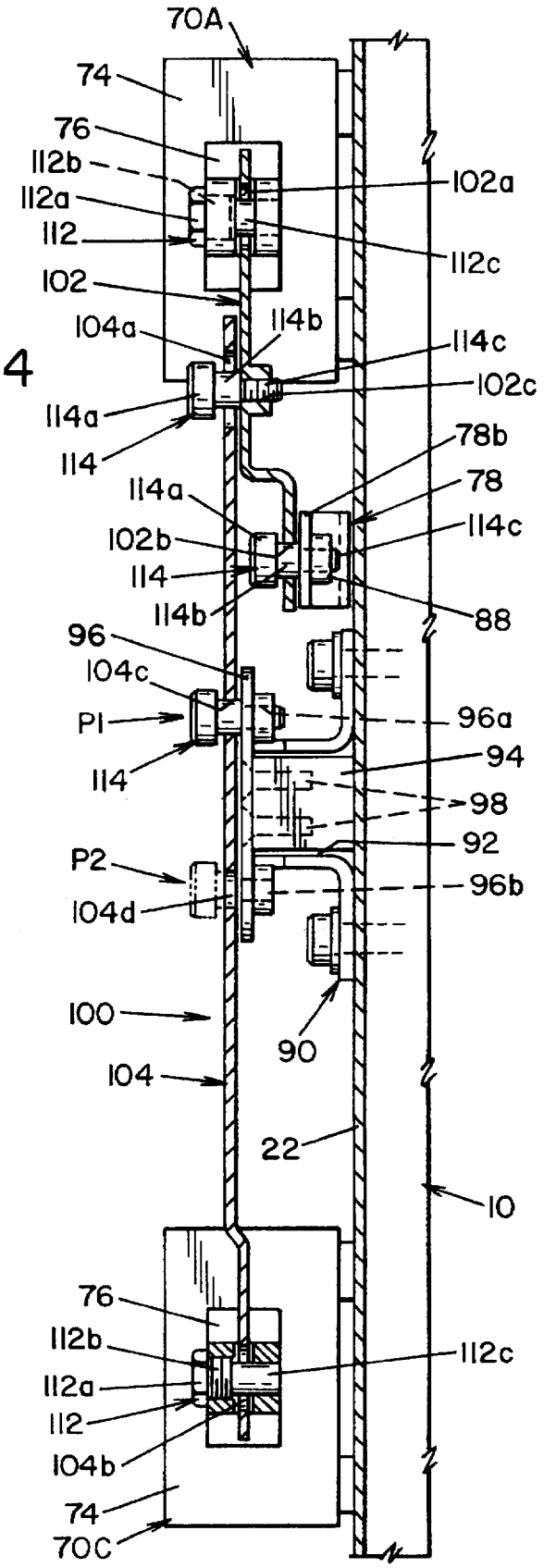
FIG. 4 is a sectional view taken along line 4—4 of FIG. 3.

A lock bar bracket 90 is fastened to platform 22 by conventional fasteners, as is shown in FIG. 4. Bracket 90 is formed to have a centrally-aligned, generally U-shaped channel 92 formed therein. Channel 92 together with the planar surface of platform 22 defines a generally rectangular passage, dimensioned to receive a lock bar 94 wherein lock bar 94 is slidable through the rectangular passage 92. Bracket 90 is positioned such that lock bar 94 is movable in a direction parallel to the direction of movement of lock arms 76 of locks 70A, 70B, 70C, and such that one end of lock bar 94 is in operable engagement with locking cam 24. A portion of channel 92 is cut away from bracket 90 to expose lock bar 94, and to allow a connector plate 96 to be attached to lock bar 94 by fastener 98 (shown in phantom in FIG. 4). Two apertures designated 96A, 96B are formed in the distal ends of plate 96 to define a first linkage attachment position (at aperture 96A) and a second linkage aperture position (at aperture 96B) as will be discussed in greater detail below.

A linkage 100 is provided to connect the lock arms of lock 70A, 70C and extension arm 78 to each other and to lock bar 94. Linkage 100 is generally comprised of a first link 102 and a second link 104. Link 102, connects lock arm 76 of lock 70A to the free end 78*b* of extension arm 78. In this respect, as best seen in FIG. 4, link 102 includes a slot 102*a* at one end, and a circular aperture 102*b* at the other end thereof, and a threaded bore 102*c* located between slot 102*a* and aperture 102*b*.

A first type fastener 112 extends through slot 102*a* and secures first link 102 to lock arm 76 of lock 70A, as best seen in FIG. 4. Fastener 112, which is of a type utilized elsewhere in linkage 100, is generally comprised of a hexagonal head portion 112*a*, an intermediate threaded body portion 112*b*, and a smooth, cylindrical portion 112*c* (as best illustrated in the lower portion of FIG. 4). Cylindrical portion 112*c* is provided as a pivotal, bearing surface to facilitate pivotal movement of first link 102 relative to lock arm 76 of lock 70A. A second type of fastener 114 having a socket head portion 114*a* and an intermediate smooth, cylindrical portion 114*b* and a threaded end portion 114*c* extends through aperture 102*b* to secure first link 102 to free end 78*b* of extension arm 78. As shown in FIG. 4, first link 102 is formed to be offset to facilitate fastener 114.

Referring now to second link 104, elongated slots 104*a*, 104*b* are formed at the distal ends thereof. A pair of spaced-apart apertures 104*c*, 104*d* are formed through link 104 between slots 104*a*, 104*b*. The spacing between apertures 104*c*, 104*d* is equal to the spacing between apertures 96*a*, 96*b* in connector plate 96 such that apertures 104*c*, 104*d* are alignable with apertures 96*a*, 96*b*. Aperture 104*c*, together with the aligned aperture 96*a* in connector plate 96, define a first linkage position designated P1 in the drawings. Aperture 104*b* and aligned aperture 96*b* of connector plate 96 define a second linkage attachment position, designated P2 in the drawings. A fastener 114 is provided to connect second link 104 to connector plate 96. Fastener 114 may be positioned at either the first attachment position P1 or the second attachment position P2. When fastener 114 is inserted at first attachment position P1, a first operating configuration is established for lock assembly 20. When fastener 114 is inserted at second attachment position P2, a second operating configuration is established for lock assembly 20.

In its first operating configuration (i.e., where fastener 114 is located at attachment position P1), locking assembly 20 is configured such that the opening of any two of the three locks 70A, 70B, 70C will permit opening or release of vault door 10. In its second operating configuration (i.e., where fastener 114 is located at second attachment position P2), the lock assembly 20 is configured such that opening of locks 70A, 70C will permit opening or release of vault door 10, or in the alternative, opening of lock 70B alone will open or release vault door 10. In this latter configuration, lock 70B is essentially a master lock which alone will permit opening of the vault door.

Figure 6:
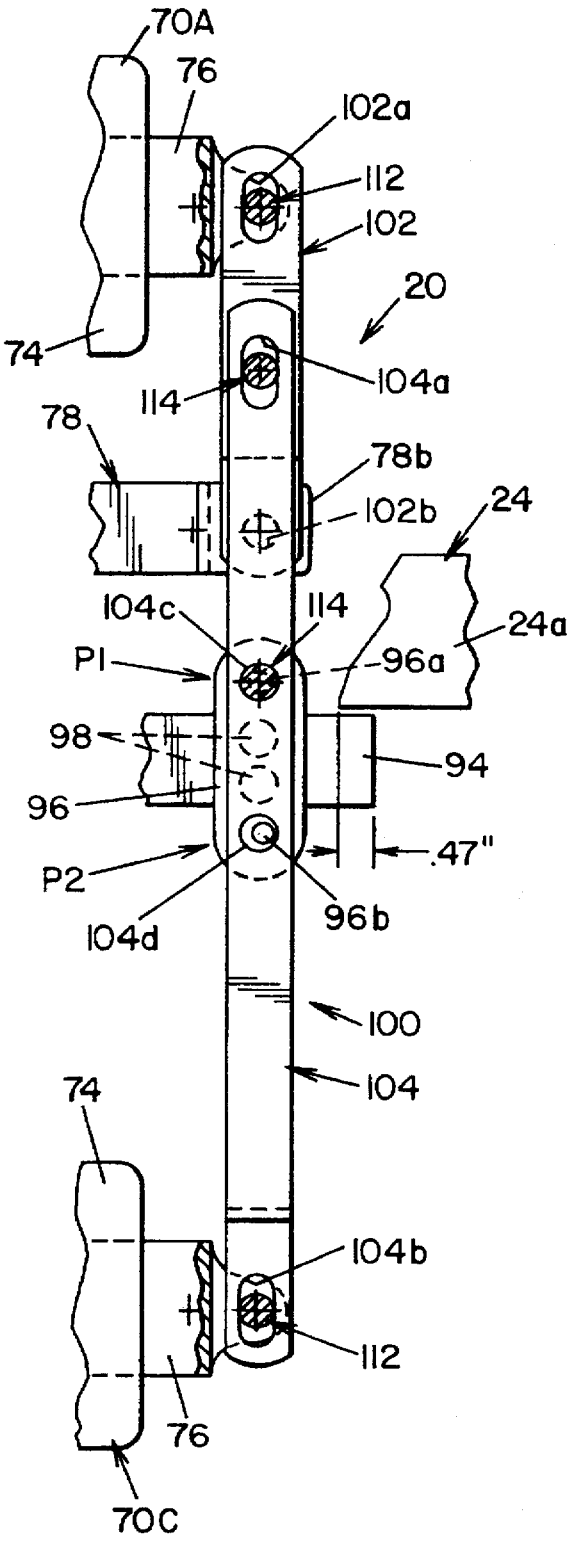
FIGS. 6–14 are enlarged elevational views of the lock links shown in FIG. 3 illustrating the operation thereof.

Referring now to FIGS. 6–14, the operation of the lock assembly heretofore described is illustrated. FIG. 6 shows lock assembly 20 in its first operational configuration (i.e., fastener 114 in attachment position P1). In the position shown, lock assembly 20 is in a door locking position, wherein lock arms 76 of locks 70A, 70B, 70C are extended in the locked position. In this position, lock bar 94 prevents counterclockwise rotation of arm 24*a* of locking cam 24.

Figure 7:
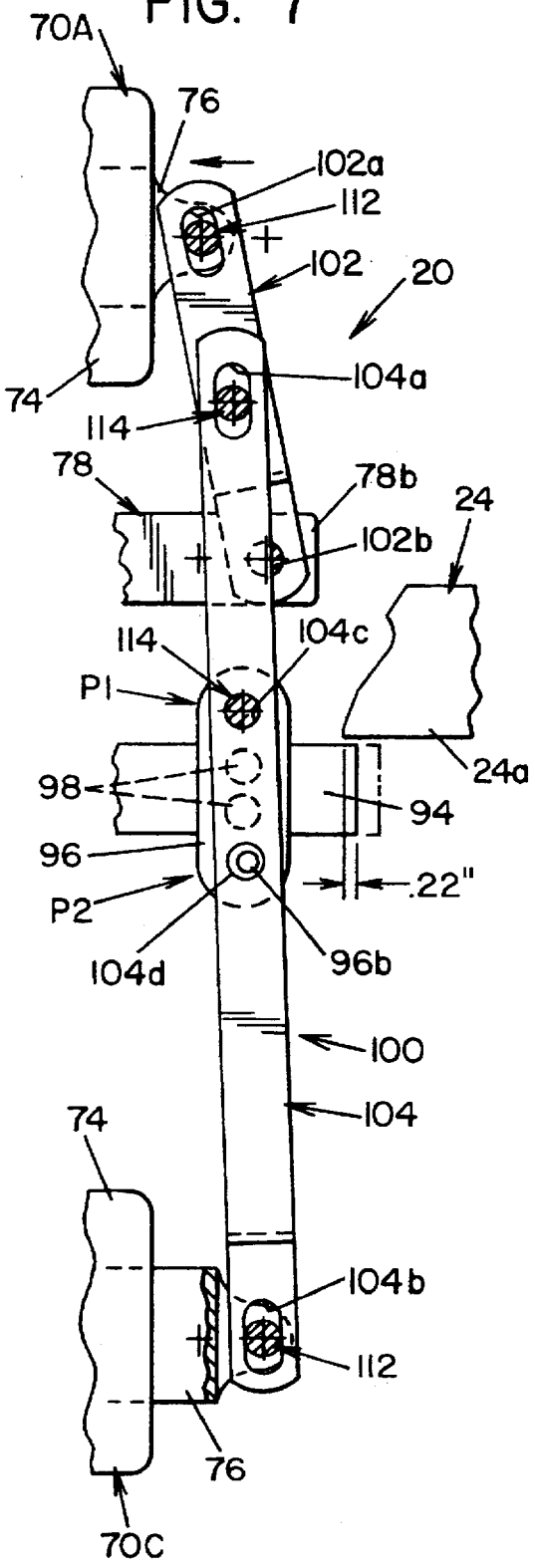
Figure 8:
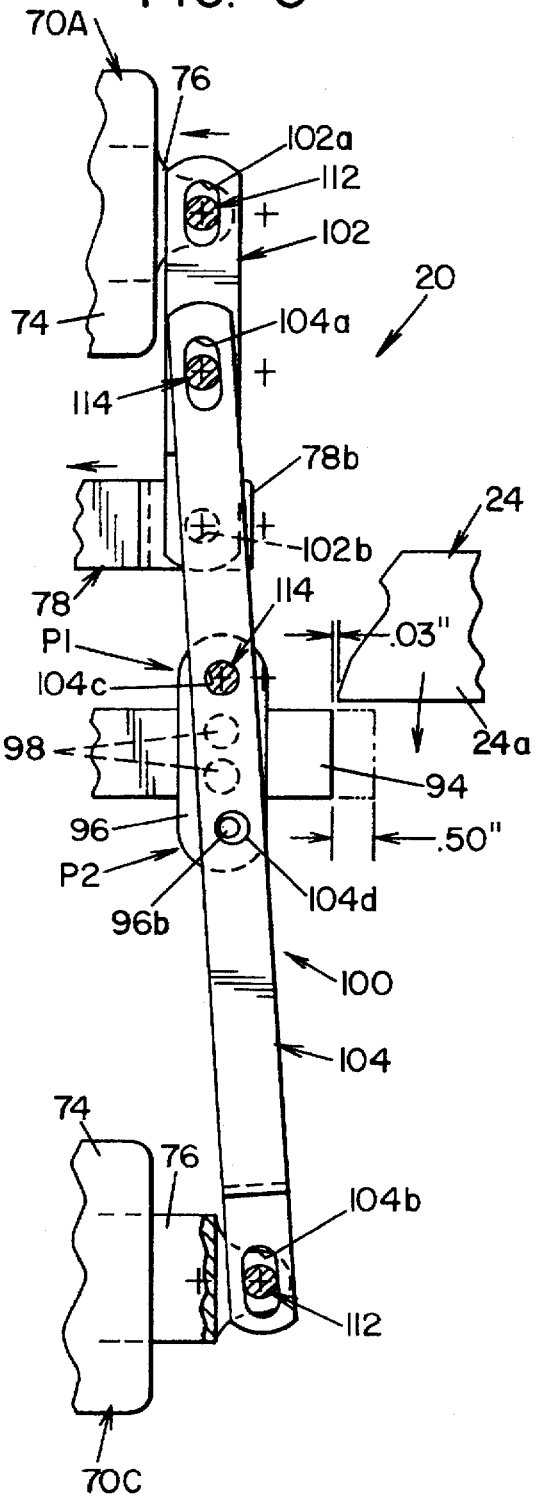

If the proper combination is entered, lock 70A may be moved to an open position (i.e., where lock arm 76 is moved to its retracted position—to the left in the drawings) as seen in FIG. 7. The upper end of link arm 102 associated with lock arm 76 of lock 70A moves to the left, causing first link 102 to pivot about its lower end which remains stationary. The pivotal rotation of first link 102 causes the end of second link 104 (which is pinned to first link 102) to pivot about its other end which is attached to lock arm 76 of lock 70C. This motion causes lock bar 94 which is attached to second link 104 at attachment location P1 to move a predetermined distance to the left as shown in FIG. 7. As seen in FIG. 7, the movement of link 102 caused by the unlocking of lock 70A, in and of itself, is not sufficient to cause lock bar 94 to move far enough to clear arm 24*a* of locking arm 24. If the proper combination to lock 70B is then entered, its respective lock arm 76 moves to its retracted position, causing extension arm 78 to move to the left, which in turn causes the lower end of link 102 to move therewith, as illustrated in FIG. 8. Such motion causes the upper end of second link 104 to move further to the left thereby moving lock bar 94 away from arm 24*a* of locking cam 24. With both locks 70A and 70B open, cam 24 is free to rotate thereby moving connector plate 32 to remove locking bolts 36 from their recesses in door frame 14 and release vault door 10.

Figure 9:
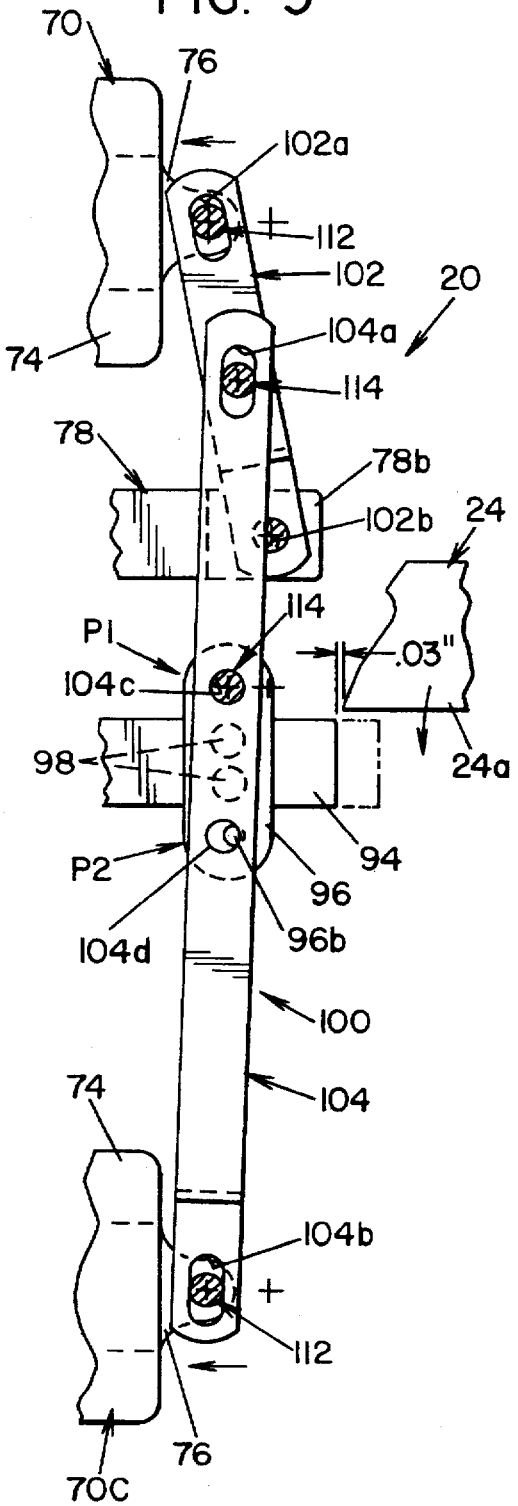

FIG. 9 shows the situation wherein after lock 70A is opened (as shown in FIG. 7), lock 70C is then opened. As shown in FIG. 9, as lock arm 76 of lock 70C is retracted, the lower end of link 104 moves to the left which in turn causes lock bar 94 to move sufficiently to clear arm 24*a* of cam 24 wherein vault door 10 again may be released.

Figure 10:
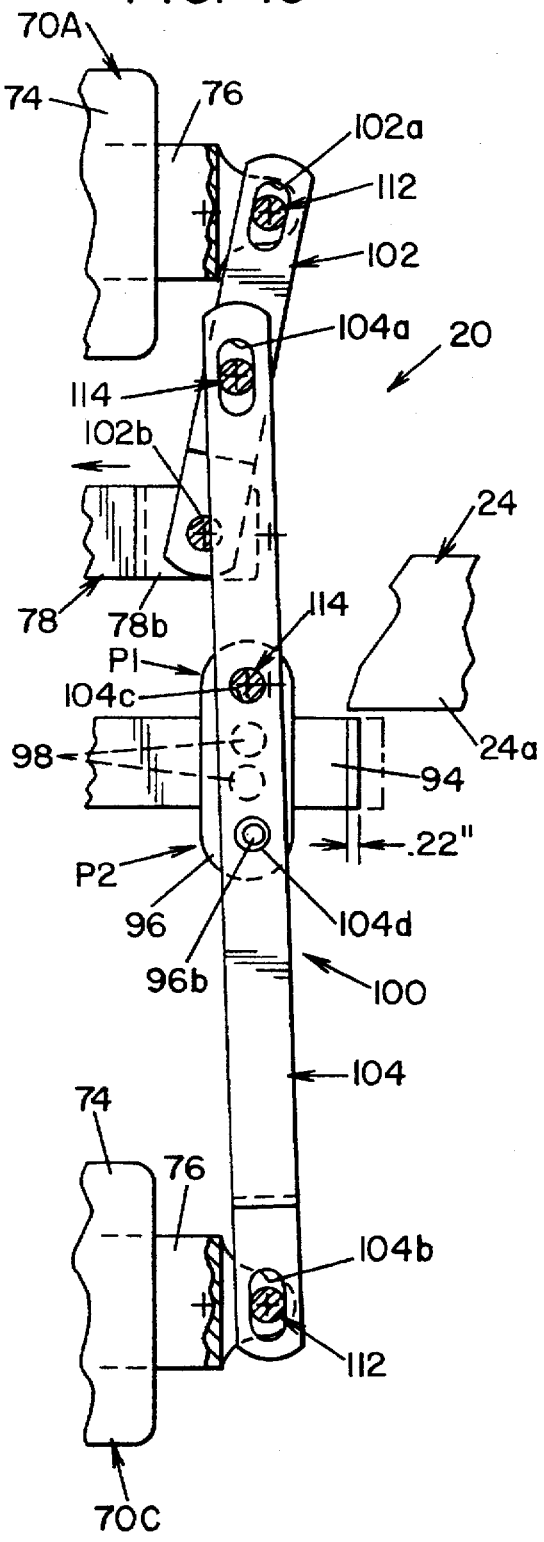
Figure 11:
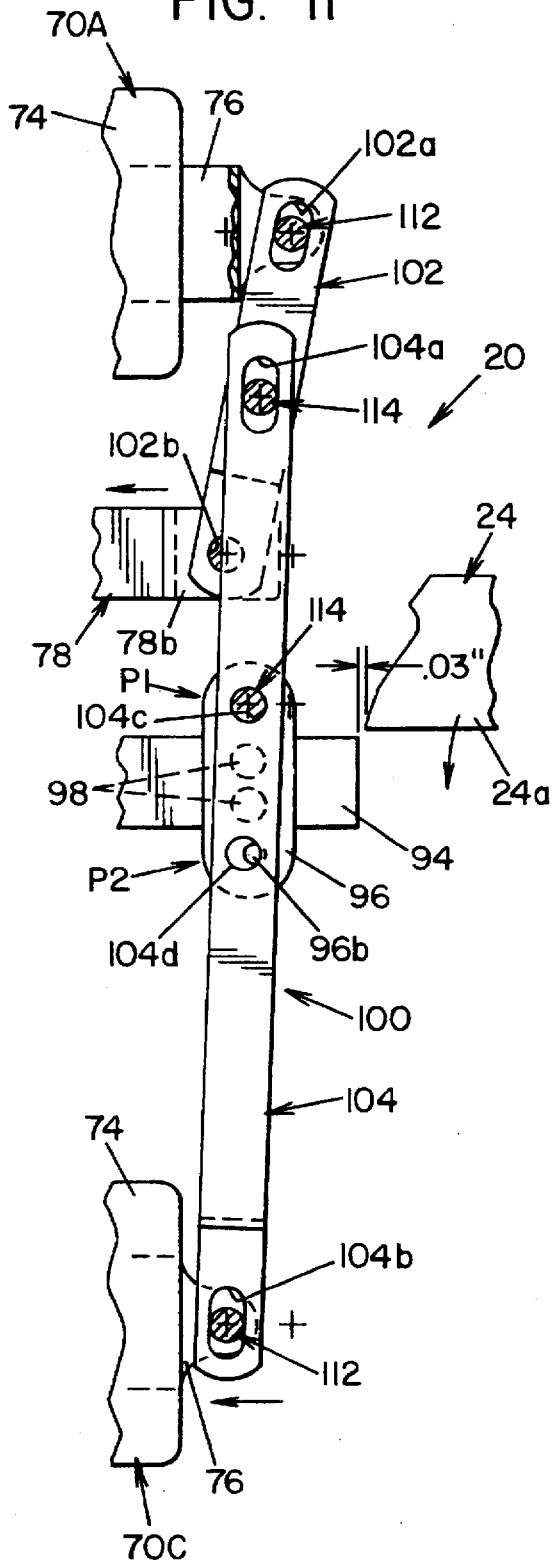

FIG. 10 illustrates a situation where lock 70B is first opened, causes the lower end of link 102 to move therewith to the left thereby causing the upper end of link 104 (and lock bar 94) to move a predetermined distance relative to arm 24*a* of cam 24. As seen in FIG. 10, the opening of lock 70B alone does not move lock bar 94 a sufficient distance to enable cam arm 24 to rotate pass same. FIG. 11 illustrates the situation where, after lock 70B is opened, lock 70C is then opened. As a result of opening lock 70C, the lower end of link 104 moves to the left moving lock bar 94 sufficiently to clear arm 24*a* of cam 24 wherein door 10 may be released.

Figure 12:
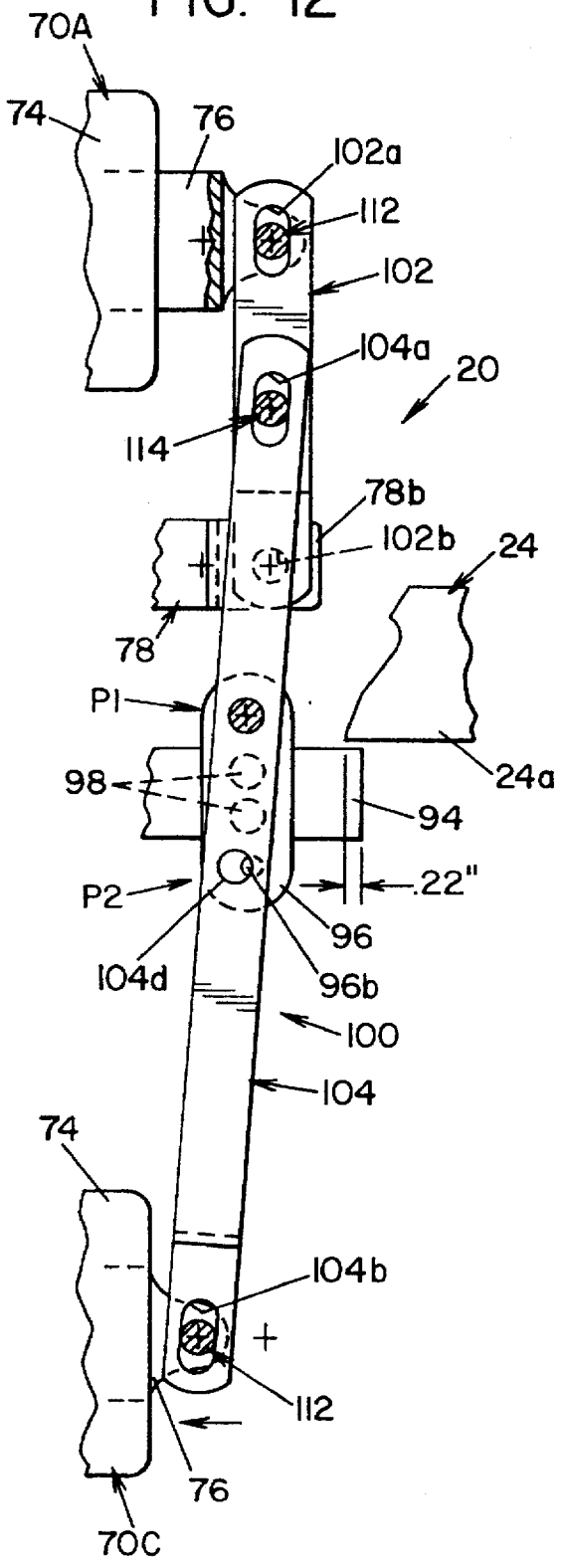

FIG. 12 illustrates the situation wherein lock 70C is first open, thereby moving the lower end of second link 104 to the left causing lock bar 94 to move a predetermined distance therewith. Again, movement of lock arm 76 of lock 70C alone is insufficient to enable cam arm 24*a* of cam 24 to dear lock bar 94. If lock 70A is then open, the situation shown in FIG. 9 is achieved wherein cam arm 24*a* is able to clear lock bar 94 and release vault door 10. In this same context, FIG. 11 shows the situation if lock 70B, instead of lock 70A, is opened after lock 70C is first opened. Again, lock bar 94 clears cam arm 24*a* of cam 24 thereby permitting release of vault door 10.

FIGS. 6–12 thus illustrate the operation of lock assembly 20 when in its first operating configuration and show how any two of the three locks 70A, 70B, 70C can be opened in any order to enable vault door 10 to be opened.

Figure 13:
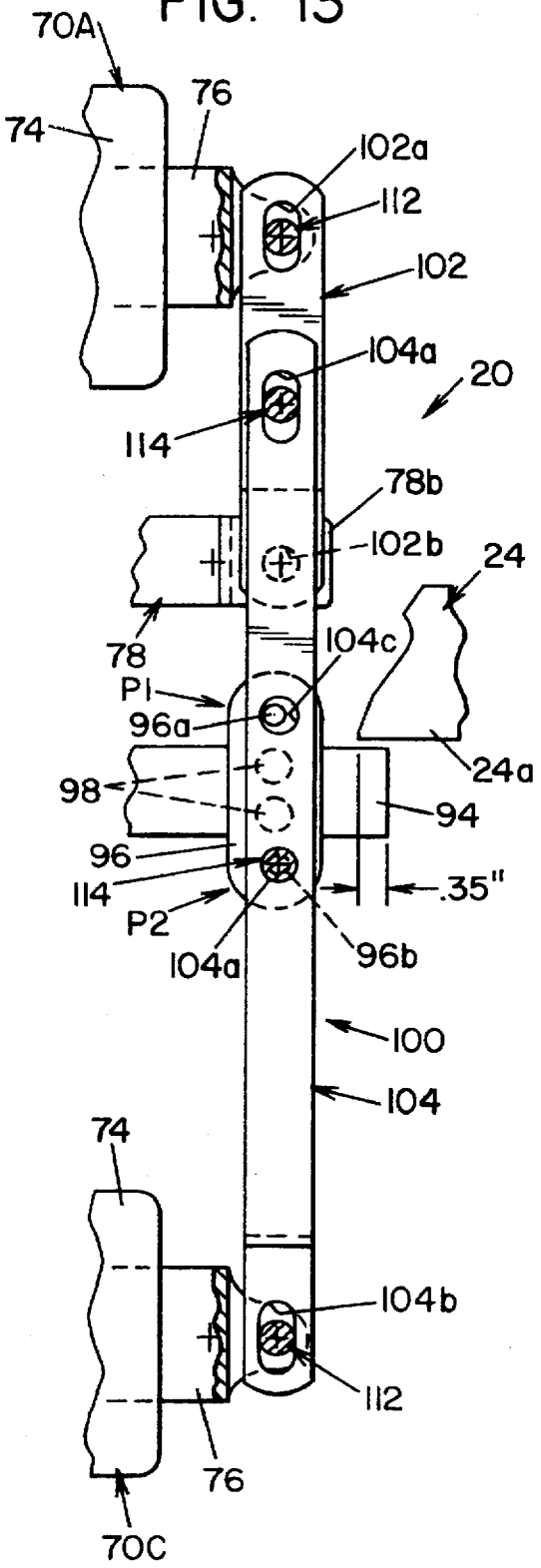
Figure 14:
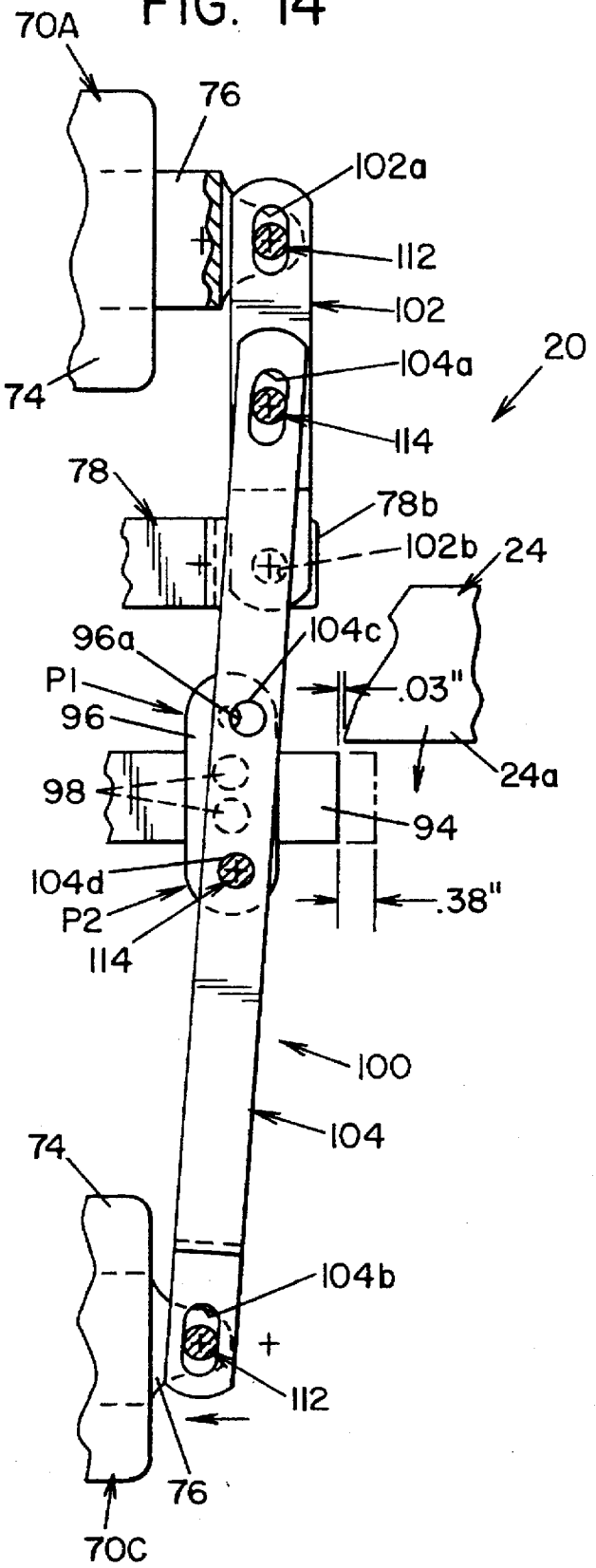

Referring now to FIGS. 13 and 14, lock assembly 20 is shown with connecting pin 114 positioned in second attachment position P2. FIG. 13 illustrates the configuration of lock assembly 20 wherein lock 70A, 70B, 70C are all in a locked position, and wherein locking bar 94 obstructs rotation of cam 24. In this configuration, the opening of lock 70C alone is sufficient to cause lock bar 94 to clear cam 24 to allow rotation thereof and to permit opening of vault door 10, as illustrated in FIG. 14. In addition, opening of lock 70A, 70B will also move locking bar 94 sufficiently to clear cam 24. This operation is basically illustrated in FIGS. 7 and 8. In this respect, as can be seen from the drawings, lock 70A and 70B will have the same affect on link 102, irrespective of whether pin 114 is in attachment position P1 or attachment position P2. Thus, with pin 114 in second attachment position P2, opening lock 70A and 70B will move lock bar 94 sufficiently to enable cam 24 to rotate and release vault door 10. Alternatively, one lock, i.e., lock 70C, may be considered a master lock and alone is sufficient to release vault door 10.

The present invention thus provides a lock assembly which may be easily and quickly configured to one of two operating configurations by merely repositioning a single fastener. In one operating configuration, opening any two of the three locks will permit opening of the vault door, and in the second operating configuration, two specific locks must be opened, or the third master lock alone may be opened, to facilitate release of the vault door.

Figure 15:
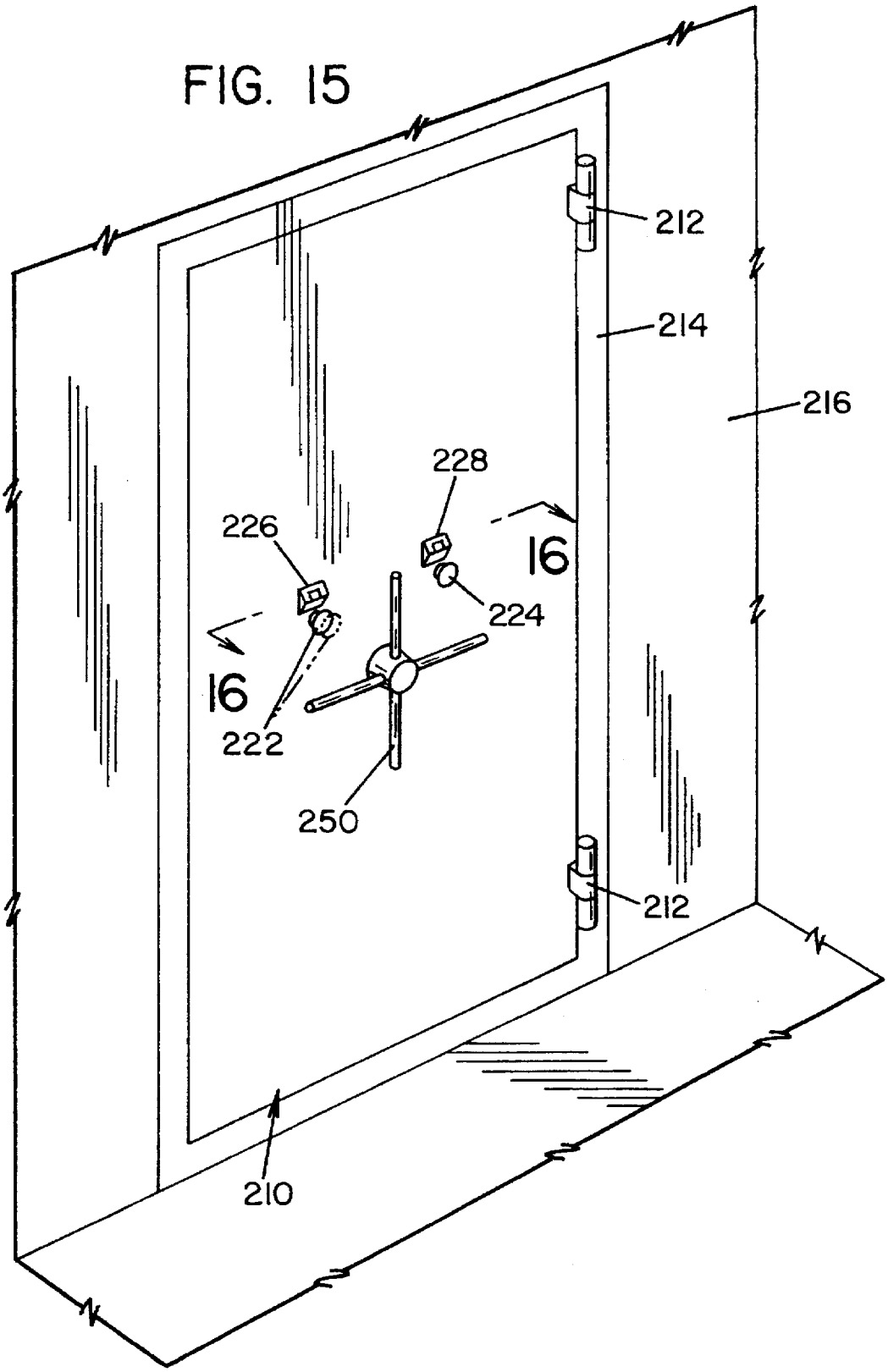
FIG. 15 is an elevational view of a vault door containing an alternative embodiment of the present invention.

Referring now to FIGS. 15–27, a second embodiment of the present invention is shown. FIG. 15 shows a vault door 210 which is generally similar to that shown in FIG. 1. In this respect, vault door 210 is mounted on hinges 212 to a door frame 214 which is formed or cast within a vault wall 216, in a conventionally known manner. A wheel handle 250 for releasing a door locking mechanism is provided. A pair of dials 222, 224 is provided on the surface of vault door 210. In the embodiment shown, dial 222 is a dual action (two position) dial having a first retracted position shown in FIG. 15 and a second extended position, shown in phantom in FIG. 15. Numerical indicators 226, 228 for visually displaying combinations are provided adjacent dials 222, 224 respectively.

Figure 16A:
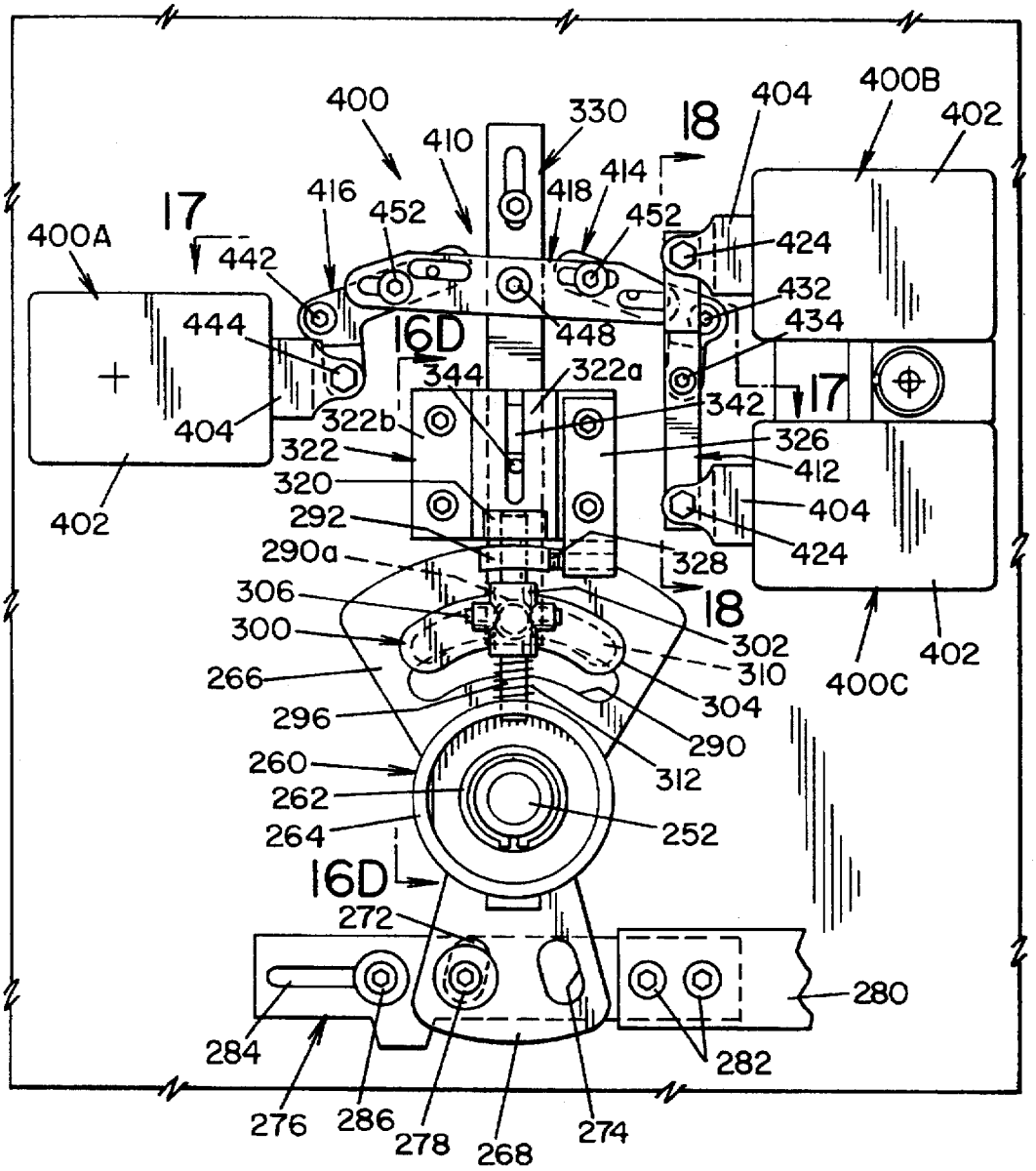
FIG. 16A is a view taken along line 16—16 of FIG. 15.
Figure 16B:
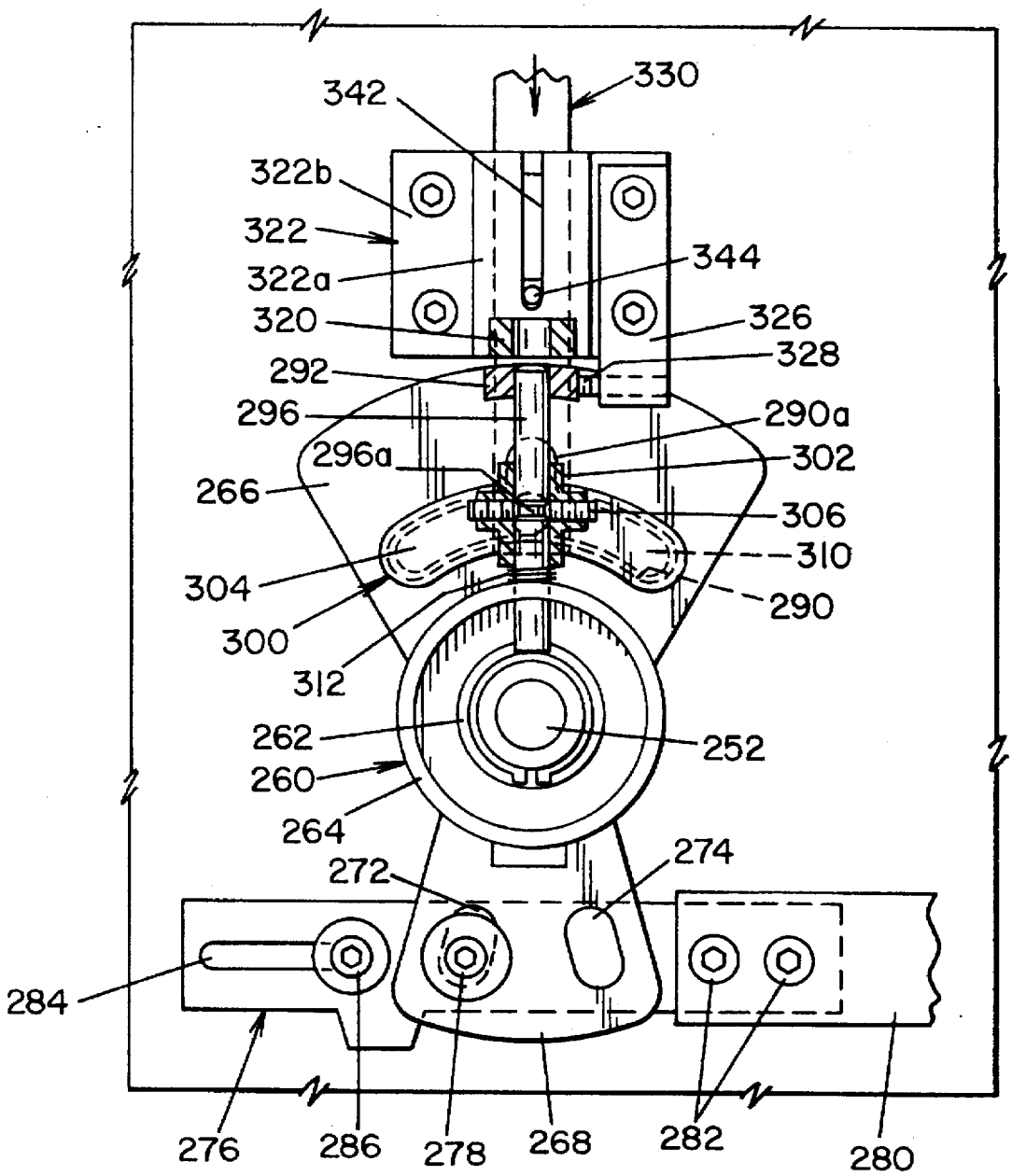
FIG. 16B and 16C are enlarged views of the locking cam and lock bar assembly shown in FIG. 16A.

Referring now to FIG. 16A, the internal components of vault door 210 are shown, as seen from the rear or back side of vault door 210. Rotatable star wheel 250 is mounted to a shaft 252 which extends through door 210. A fly wheel 260 includes a cylindrical central hub 262 which receives shaft 252 and is connected thereto for the rotation therewith. A cylindrical wall 264 surrounds hub 262 and defines an annular cavity therewith. An upper plate 266 and a lower plate 268 extend from cylindrical wall 264. Lower plate 26 includes a pair of diverging slots 272, 274 which are provided to attach fly wheel 260 to a connector plate 276 by means of a fastener 278. Plate 276 in turn is attached to a connector bar 280 by conventional fasteners 282. Bar 280 would typically be attached to a door bolt locking arrangement (not shown) for releasing and securing vault door 210. An elongated slot 284 having a fastener 286 extending therethrough aligns plate 276 and bar 280 relative to the door bolt locking arrangement.

Figure 16C:
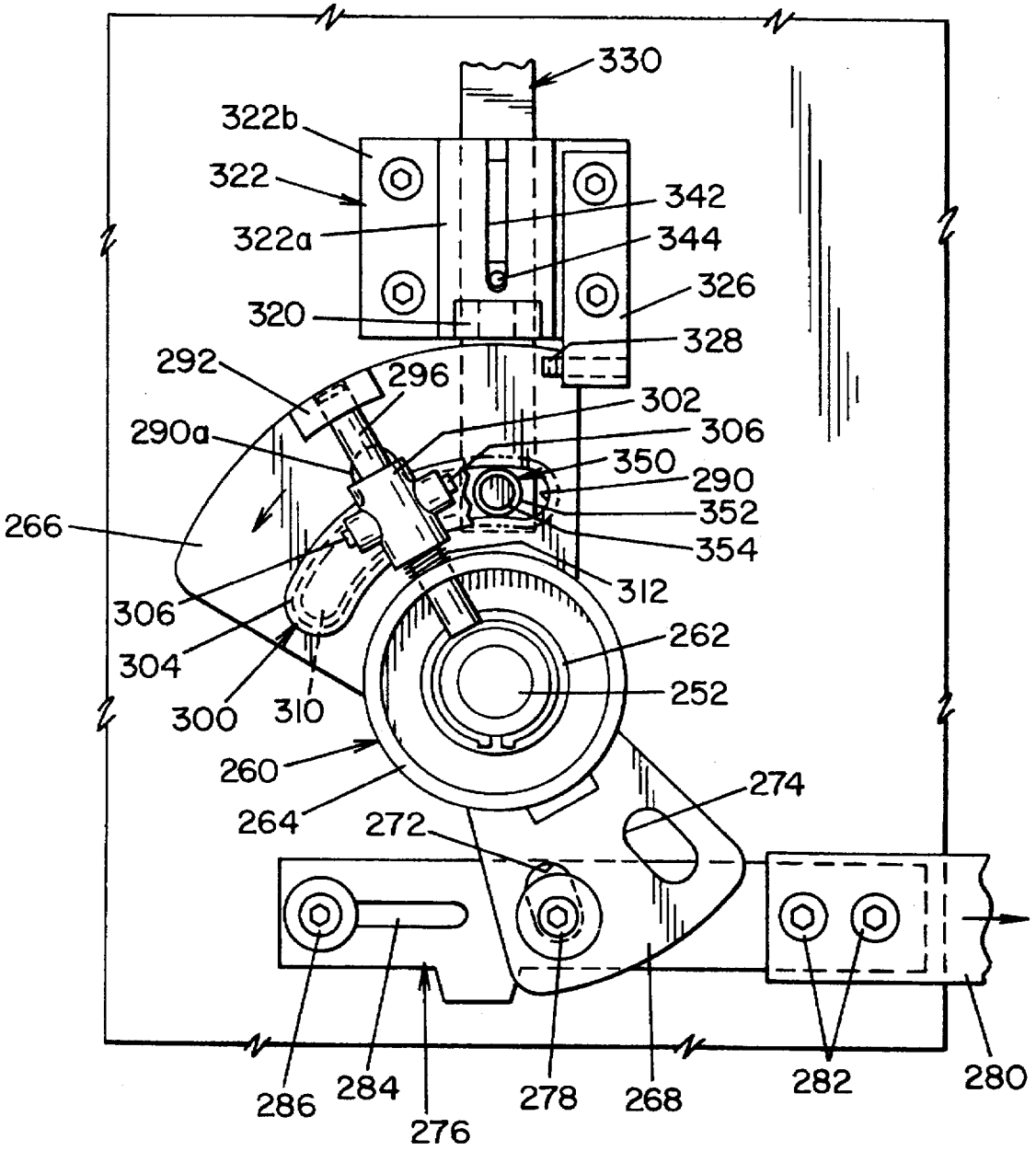
Figure 16D:
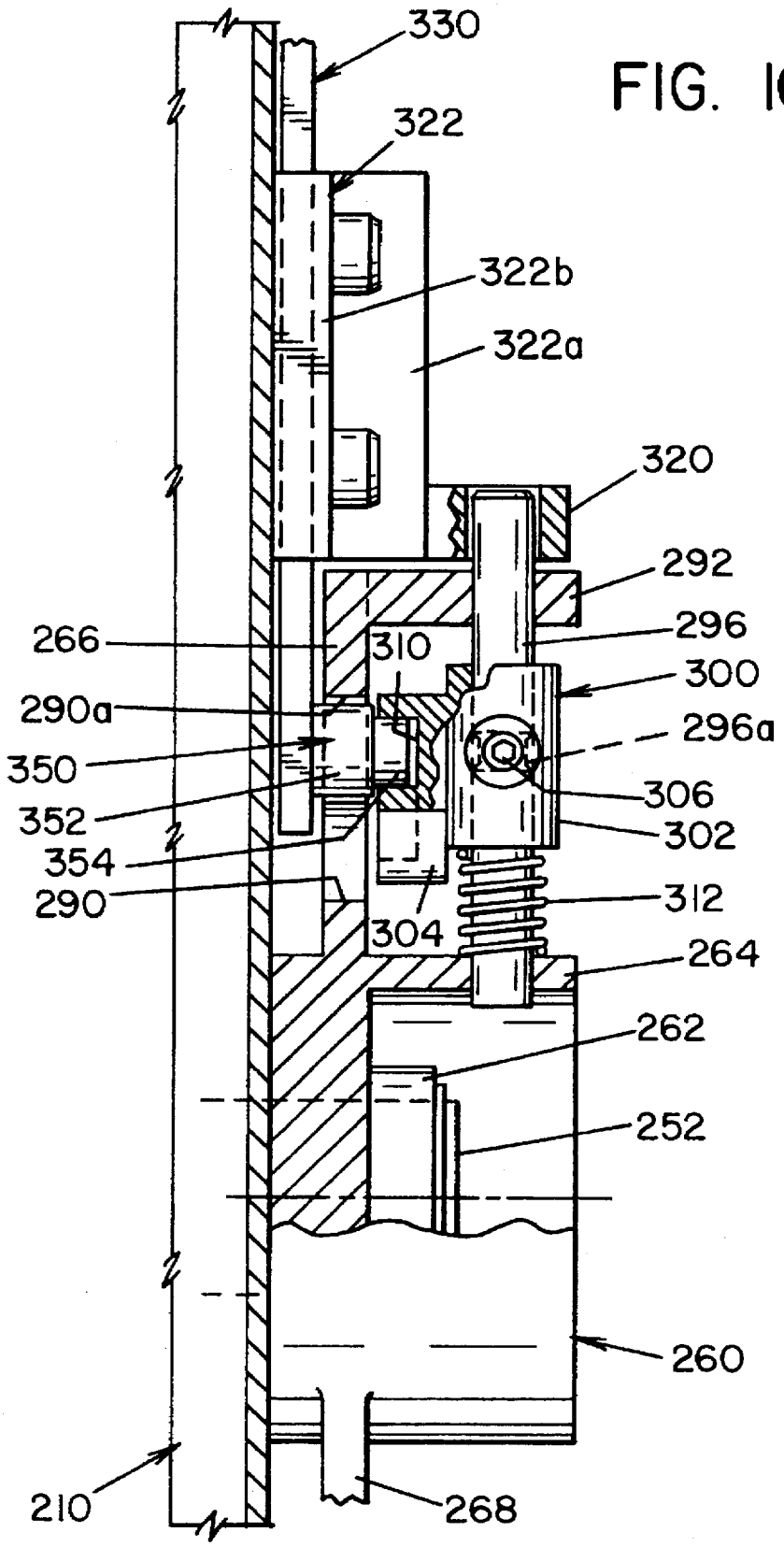
FIG. 16D is a sectional view taken along line 16D—16D of FIG. 16A.

Upper plate 266 of fly wheel 260 is generally a fan-shaped flat plate including an arcuate slot 290 formed therein. Slot 290 is generally symmetrical about the axis of shaft 252 and includes a radially extending recess 290a (best seen in FIG. 16B). Upper plate 266 includes a guide block 292 at the upper end thereof. A cylindrical bore through guide block 292 is in axial alignment with an equally sized bore through cylindrical wall 264 to receive a locking pin 296 therethrough. Locking pin 296 includes a necked-down portion 296*a* located between the ends thereof, as best seen in FIG. 16D. A follower 300 having a cylindrical body portion 302 and an arcuate body portion 304 is provided for mounting on pin 296. Locking pin 296 extends through a bore in the cylindrical body portion 302 of follower 300 and is secured thereto by conventional set screws 306 which attach to the neck down portion 296*a* of locking pin 296, as best seen in FIG. 16D. Arcuate portion 304 of follower 300 includes an arcuate slot 310 formed therein to face the surface of upper plate 266 as best seen in FIG. 16D. A biasing spring 312 disposed between cylindrical wall 262 of fly wheel 250 and cylindrical body portion 302 of follower 300 surrounds locking pin 296. Biasing spring 312 is operable to bias follower 300 (and locking pin 296) to a locking position generally shown in FIGS. 16A and 16D. In this position, the upper end of locking pin 296 extends into a bore in a block 320 provided on a bracket 322. Bracket 322 includes a central U-shaped channel portion 322*a* together with laterally extending flange portions 322*b*. Conventional fasteners secure flange portions 322*b* to the inner surface of vault door 210 wherein U-shaped channel portion 322*a* defines a generally rectangular opening or passage with the surface of door 210. The rectangular opening is to receive an actuator bar 330. Actuator bar 330 includes a stepped pin 350 having a lower portion 352 and an upper portion 354. Lower portion 352 of pin 350 is dimensioned to be received in slot 290 and recess 290*a* in upper plate 266 of fly wheel 250. Upper portion 354 of pin 350 is dimensioned to be received in arcuate slot 310 of arcuate portion 304 of follower 300, as is shown in FIGS. 16C and 16D. An auxiliary mounting block 326 is mounted to bracket 322 and includes a set screw 328 to form an adjustable stop to limit clockwise rotation of fly wheel 260. A slot 342 formed in U-shaped channel 322*a* is dimensioned to receive a pin 344 mounted to actuator bar 330 so as to align actuator bar relative to fly wheel 260.

Referring now to FIG. 16A, lock assembly 400 is best seen. Lock assembly 400 is comprised of three spaced-apart locks, designated 400A, 400B and 400C on the drawings. In the embodiment shown, locks 400A, 400B and 400C are generally identical and are conventionally known mechanical combination locks. Each lock 400A, 400B and 400C has a lock housing 402 and a lock arm 404 which extends therefrom. Each lock arm 404 is movable between an extended locked position, as is shown in FIG. 16A, and a retracted unlocked position. In the embodiment shown, locks 400A, 400B and 400C are arranged in a generally triangular pattern such that lock 400A is on one side of locking pin 296 and locks 400B and 400C are on the opposite side of locking pin 296. Lock arms 404 are generally parallel, and lock arm 404 of lock 400A extends in a direction opposite to that in which lock arms 404 of locks 400B and 400C extend.

A linkage 410 connects locks 400A, 400B and 400C to each other. Linkage 410 includes a connector plate 412, a first lever 414, a second lever 416 and a link 418. Connector plate 412 connects lock arm 404 of lock 400B to lock arm 404 of lock 400C. In this respect, the distal ends of connector plate 412 include elongated slots 422 which receive pins 424 which connect lock arms 404 to connector plate 412.

First lever 414 is generally L-shaped and is mounted for pivotal movement about a fixed axis, designated 432 in the drawings. One end of first lever 414 is pinned to connector plate 412 by a pin 434 for movement therewith. The other end of the first lever includes first and second spaced-apart apertures **414*a* and 414*b*, which are used to connect first lever 414 to link 418**, as will be described in greater detail below.

Figure 26:
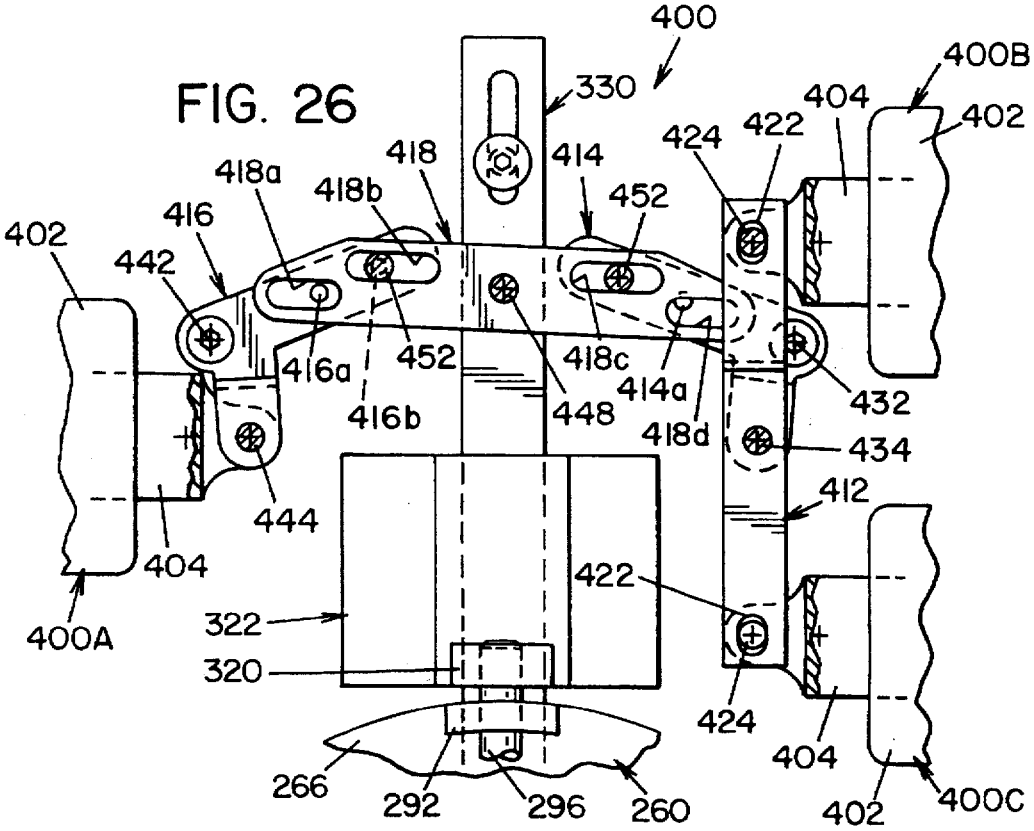
FIGS. 26–27 are enlarged views of the locking assembly shown in FIG. 16A illustrating the operation of the lock assembly when in its second operating configuration.
Figure 27:
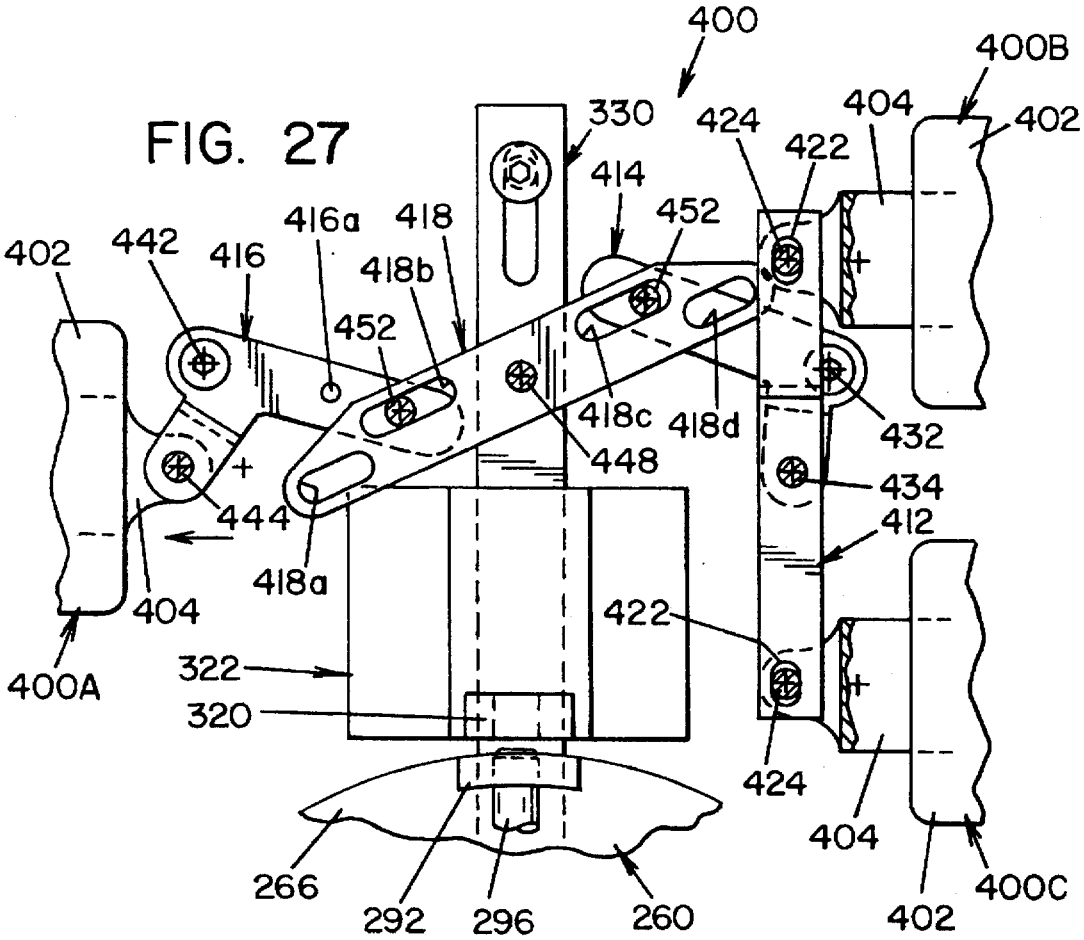

Second lever 416 is generally similar to first lever 414. In this respect second lever 416 is also L-shaped and is mounted for pivotal movement about a fixed axis, designated 442 in the drawings. One end of second lever 416 is pinned to lock arm 404 of lock 400A by pin 444 for movement therewith. The other end of second lever 416 includes first and second spaced apart apertures **416*a* and 416*b*, which are used to connect second lever 416 to link 418. Link 418 is an elongated plate which is pivotally mounted to actuator 330 by pin 448. Elongated slots, designated 418*a*, 418*b*, 418*c* and 418*d* are formed in the opposite ends of link 418. Slots 418*a*, 418*b*, 418*c* and 418*d* are positioned to be alignable with apertures 414*a* and 414*b* in first lever 414 and apertures 416*a* and 416*b* in second lever 416. In this respect, a pair of pins 452 connect link 418 to first and second levers 414, 416. Importantly, depending upon the positions of pins 452, a first or second operating configuration is established. Specifically, when a pin 452 is positioned in aperture 416*a* of second lever 416 (i.e., through slot 418*a* of link 418) and another pin 452 is positioned in aperture 414*b* of first lever 414 (i.e., through slot 418*c* of lever 418) a first operating configuration is established. FIGS. 19–25 illustrate the operation of lock assembly 400 when in its first operating configuration. If pin 452 in aperture 416*a* and slot 418*a* is moved into aperture 416*b* and second lever 416 (i.e., through slot 418*b* of link 418) a second operating configuration of lock assembly 400 is established, as illustrated in FIGS. 26 and 27**.

Figure 19:
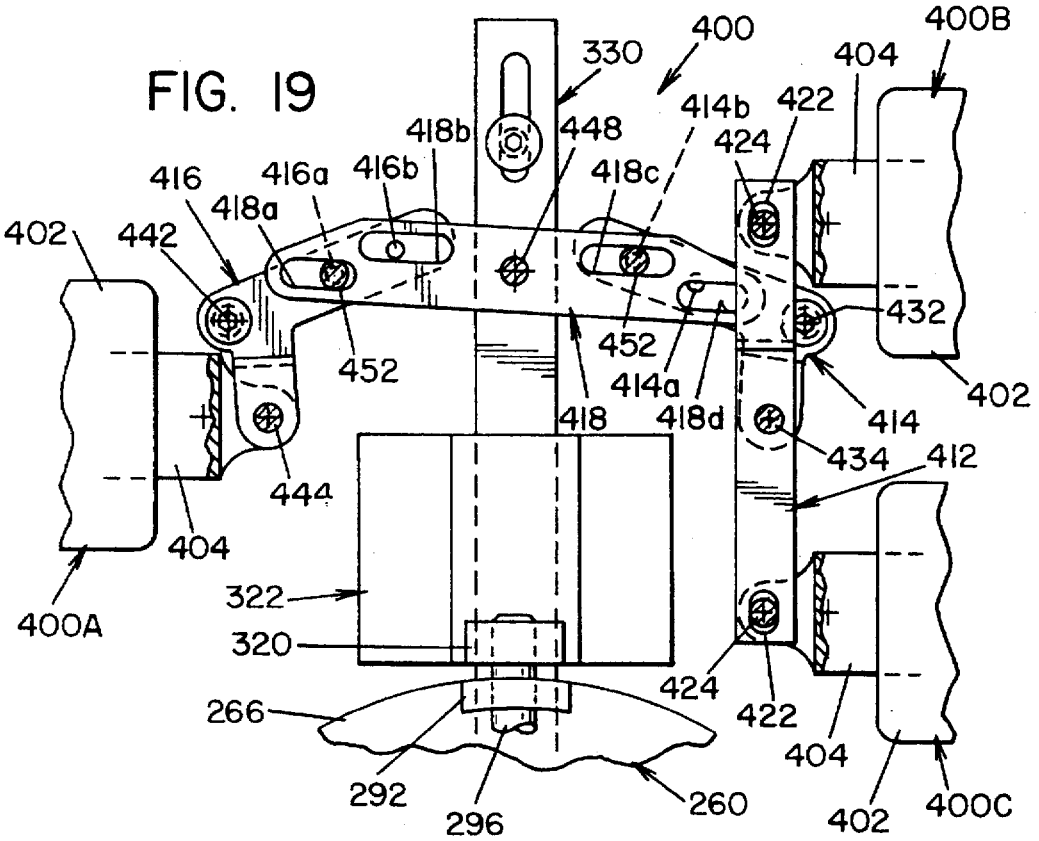
FIGS. 19–25 are enlarged views of the locking assembly shown in FIG. 16A illustrating the operation of the lock assembly when in its first operating configuration.

Referring now to FIGS. 19–27, the operation of the lock assembly 400 when in its first operating configuration is shown. FIG. 19 shows lock assembly 400 in a door-locking position, wherein lock arms 404 of locks 400A, 400B and 400C are extended in the locked position. In this position, locking pin 296 extends into block 320 which prevents counterclockwise rotation of fly wheel 250.

Figure 20:
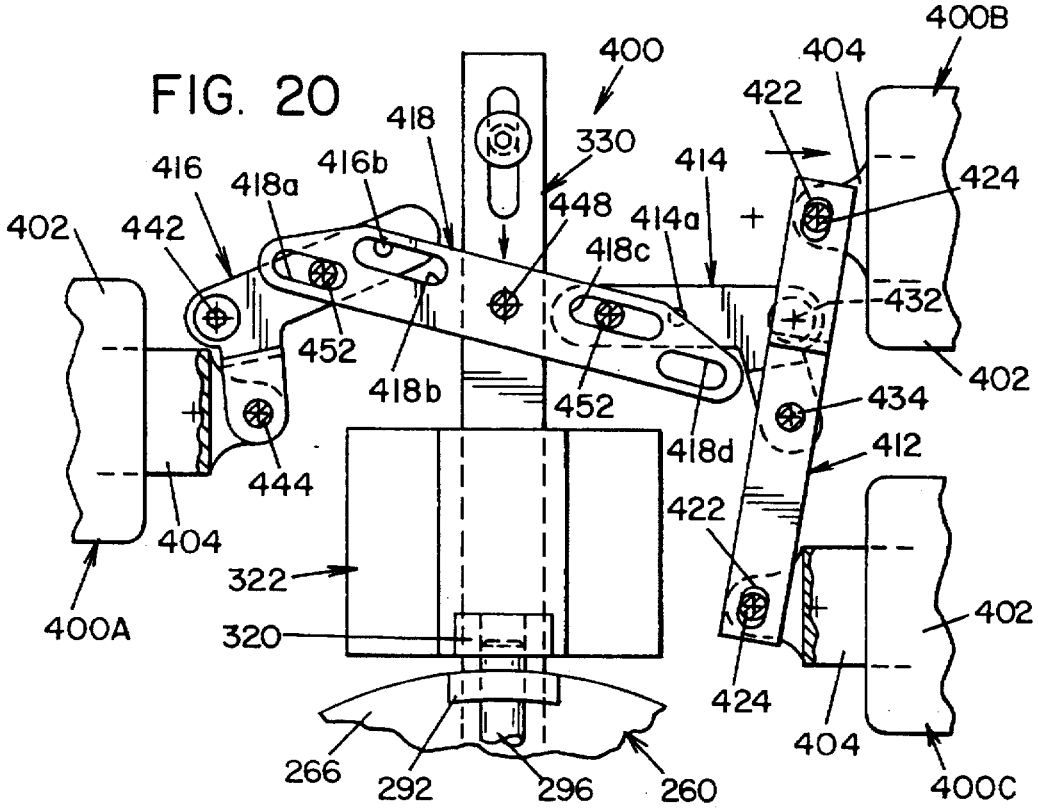

When lock 400B is unlocked, lock arm 404 of lock 400B retracts into the position shown in FIG. 20. The upper end of connector plate 412, which is connected to lock arm 404 of lock 400B, moves to the right causing first lever arm 414 to rotate slightly counterclockwise about axis 432, as is shown in FIG. 20. This movement exerts a downward pressure on the right-hand side of link 418 causing downward movement of actuator bar 330.

Referring now to FIG. 16D, as actuator bar 330 moves downward, upper portion 354 of pin 350, which is confined within arcuate slot 310 of follower 300 causes follower 300 to move downward. As will be appreciated downward movement of follower 300 causes locking pin 296 to move therewith. As actuator bar 330 moves downward, portion 352 of pin 350 move out of recess **290*a* into slot 290**.

Figure 21:
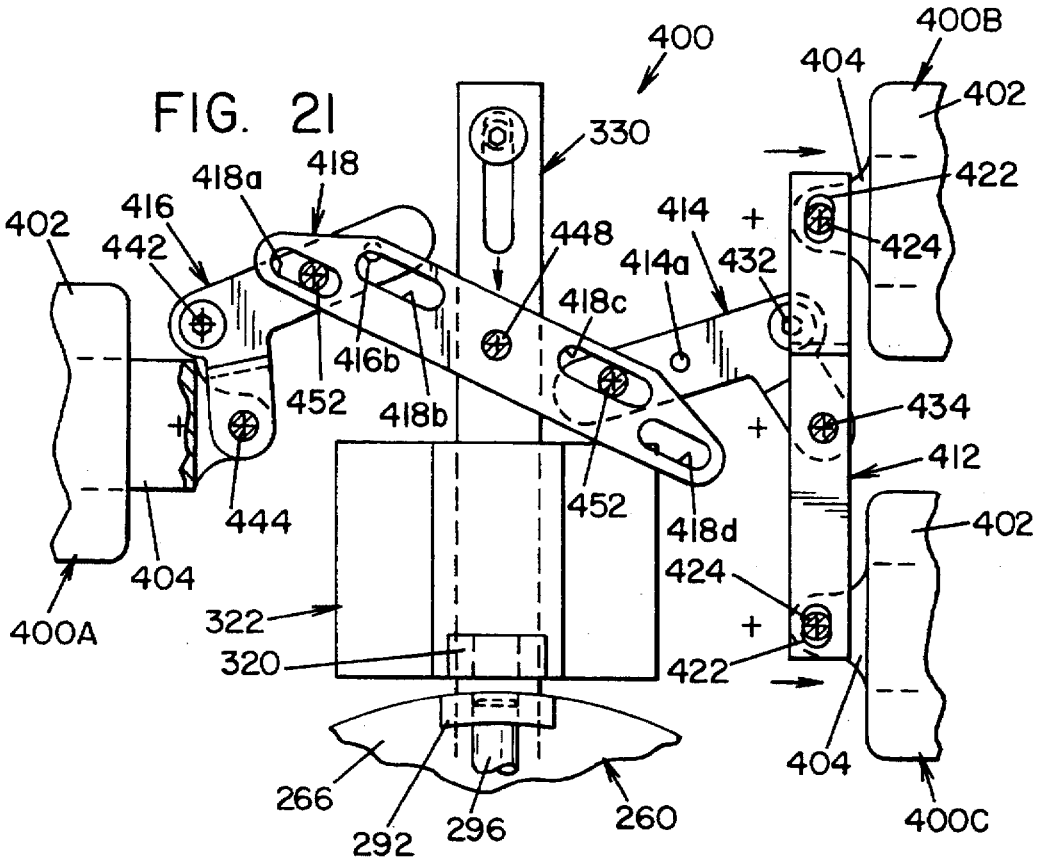

Referring now to FIG. 21, unlocking lock 400C causes lock arm 404 thereof to retract to the position shown, wherein the lower end of connector plate 412 moves towards the right, which further rotates first lever 414 counterclockwise about axis 432. This causes further downward movement of actuator bar 330. In this respect, when both lock arms 404 of locks 400B and 400C are retracted to the unlocked position, actuator bar 330 moves downward enough so that via follower 300, locking pin 296 is eventually withdrawn completely from block 320. In other words the upper portion 354 of pin 350 exerts downward pressure on arcuate slot 310 of follower 300, moving follower 300 and locking pin 296 downward out of the cylindrical bore in guide block 292, to the position shown in FIG. 16B. Fly wheel 60 is then free to move in a radial path about the axis of shaft 252 when an operator turns rotatable star wheel 250 as shown in FIG. 16C.

As seen in FIG. 16C, lower portion 352 of pin 350 is free to move through arcuate slot 290 in plate 266, and upper portion 354 of pin 350 moves through arcuate slot 310 of follower 300. This arrangement allows fly wheel 260 to rotate about the axis shaft 252, while actuator bar 330 remains stationary.

When lock assembly 400 is in its first operating configuration as described above, the movement of any two lock arms 404 from the locked to the unlocked position will move actuator bar 330 into its unlocked position where lower portion 352 of pin 350 moves completely into recess 290 and moves locking pin 296 out of the cylindrical bore in guide block 292.

Figure 22:
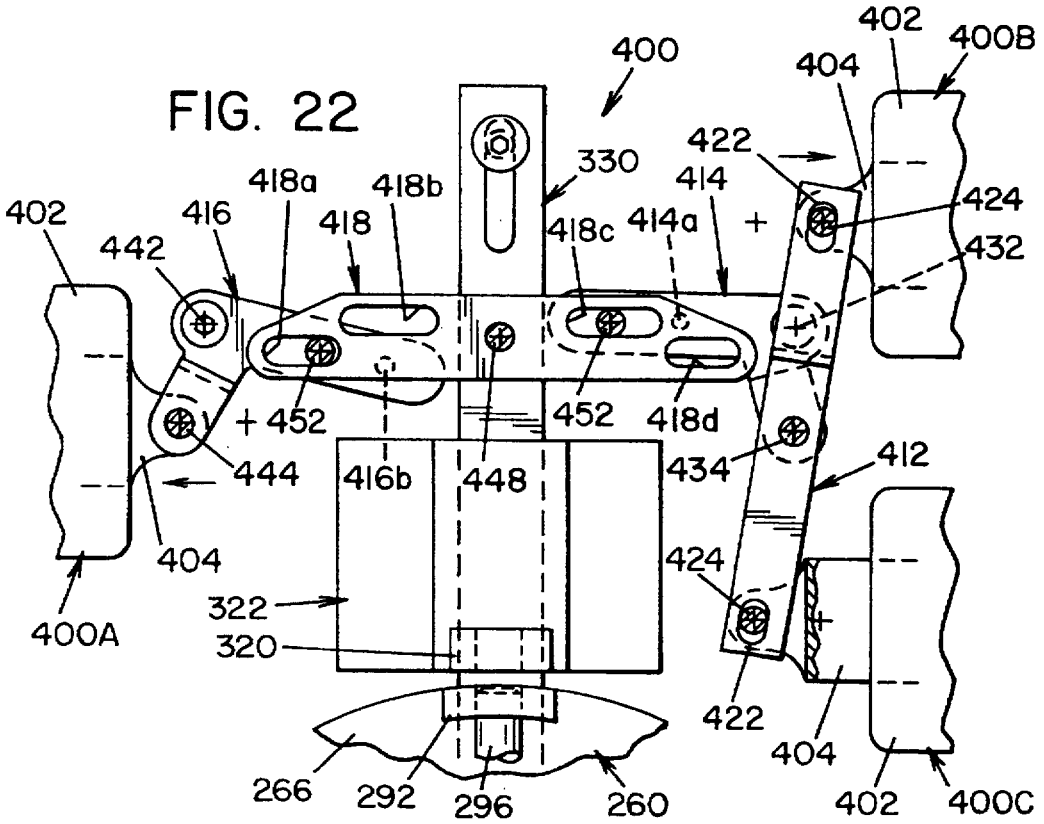

FIG. 22 shows lock assembly 400 with lock arms 404 of locks 400A and 400B being retracted. As shown, in this position, actuator bar 330 is again moved sufficiently downward such that locking pin 296 is again withdrawn from block 320 on bracket 322.

Figure 23:
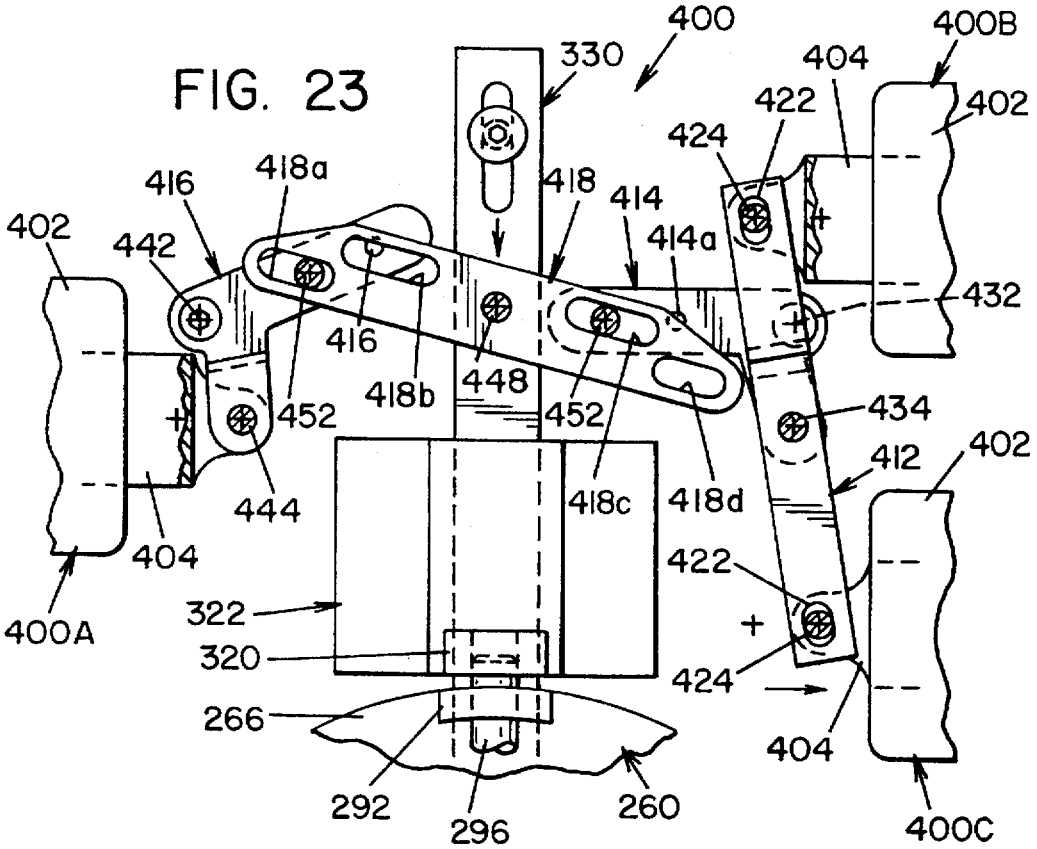
Figure 24:
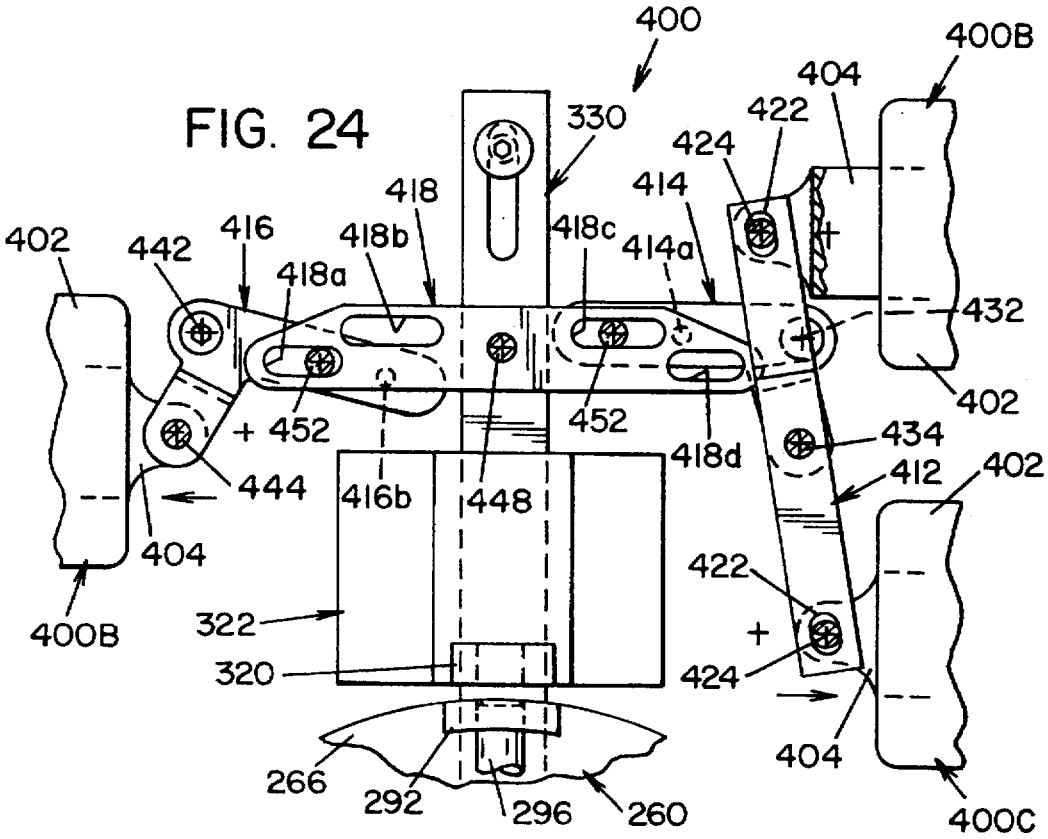

FIGS. 23 and 24 respectively show the relative position of lock assembly 400 when lock arm 404 of lock 400C is first retracted and then lock arm 404 of lock 400A is retracted. Again, locking pin 296 is withdrawn from block 320 to permit rotation of flywheel 260.

Figure 25:
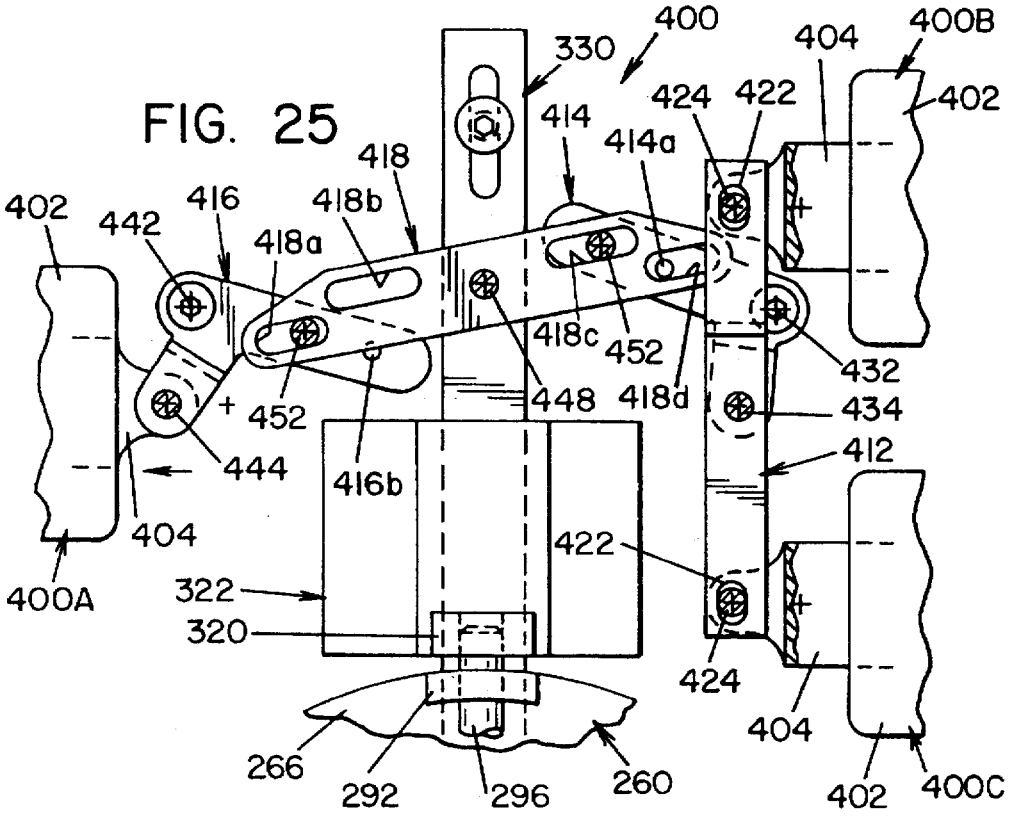

FIG. 25 shows the relative position of lock assembly 400 when lock 400A is unlocked and lock arm 404 is retracted in lock housing 402. If lock 400B is then unlocked, lock assembly assumes the position shown in FIG. 22. As discussed above, in this position, locking pin 296 is withdrawn from block 320 and fly wheel 260 is free to rotate. If after lock 400A is first opened (FIG. 25), lock 400C is then opened, lock assembly 400 assumes the position shown in FIG. 24. Again, pin 296 is withdrawn from block 320 and flywheel 260 is free to rotate and release vault door 210.

As illustrated in FIGS. 19–25, unlocking or opening any two of the three locks 400A, 400B, 400C, in any order, will permit opening of vault door 210.

Referring now to FIGS. 26 and 27, lock assembly 400 is shown in a second operating configuration. As indicated above, lock assembly 400 may be converted from its first operating configuration (shown in FIGS. 19–25) to its second operating configuration, by moving pin 452 from aperture 416*a* in second lever 416 to aperture 416*b* (i.e., through slot 418*b* of lever 418). FIG. 26 shows lock assembly 400 in its second operating configuration with all three locks 400A, 400B, 400C in a locked position. In this second configuration, the opening of lock 400A alone is sufficient to move actuator 330 downward wherein pin 296 clears block 320, as illustrated in FIG. 27. Alternately, in this second operating configuration, the two other locks (i.e. locks 400B and 400C) will also release vault door 10. In this respect, because link 418 is connected to first lever 414 in the same manner in both of the first and second operating configurations, retraction of lock arms 404 of locks 400B and 400C will have the same effect on actuator 330, as illustrated in FIG. 21. In this second operating configuration, lock 400A may be considered a master lock, and alone is sufficient to release vault door 210.

The present invention thus provides a three lock assembly for use on vault doors which may be easily and quickly configured to one of two operating configurations wherein in one configuration, opening any two of the three locks will permit opening of the vault door and, in a second configuration, two specific locks, or the remaining third lock alone may be opened to permit release of the vault door. Modifications and alterations to the structure shown in the drawings will become apparent to those skilled in the art after reading the present specification. It is intended that all such modifications and alterations be included insofar as they come within the scope of the patent as claimed or the equivalents thereof.

What is claimed is:

1. A lock assembly for use on a security door for locking and unlocking said security door, said lock assembly comprised of:

a lock component movable a predetermined distance between a first position locking said door and a second position unlocking said door;

three spaced-apart locks, each of said locks having a lock arm movable a set distance between a locked position and an unlocked position;

a linkage for connecting said locks to said lock component to cause movement of said lock component in response to movement of each of said lock arms, wherein said linkage is a connector bar pivotally connecting the lock arms of a first lock and a second lock of said three locks;

a first lever pivotable about a first fixed axis, said first lever having a first end pivotally connected to said connector bar for movement therewith, and a second end movable about said first fixed axis in response to movement of said first end;

a second lever rotatable about a second fixed axis, said second lever having a first end pivotally connected to the lock arm of a third lock of said three locks for movement therewith and a second end movable in response to movement of said first end; and a link having one end pivotally connectable to said second end of said first lever and a second end connectable by a connection pin to the second end of said second lever, said linkage having a first pin location and a second pin location, wherein when said connection pin is in said first pin location said link assumes a first operating configuration, and when said connection pin is in said second pin location said link assuming a second operating configuration, when in said first operating configration movement of the lock arms of any two of said three locks form said locked position to said unlocked position causes said link to move said lock component to said second position, and when in said second operating configuration movement of the lock arms of a specific two of said three locks or movement of the lock arm of the remaining of said three locks causes said link to move said lock component to said second position.

2. A lock assembly for use on a security door for locking and unlocking said security door, said lock assembly comprising:

a lock component movable a predetermined distance between a first position locking said door and a second position unlocking said door;

three spaced-apart locks, each of said locks having a lock arm movable a set distance between a locked position and an unlocked position;

a connector bar pivotally connecting the lock arms of a first lock and a second lock of said three locks;

a first lever pivotable about a first fixed axis, said first lever having a first end pivotally connected to said connector bar for movement therewith, and a second end movable about said first fixed axis in response to movement of said first end;

a second lever rotatable about a second fixed axis, said second lever having a first end pivotally connected to the lock arm of a third lock of said three locks for movement therewith and a second end movable in response to movement of said first end; and a link being pivotally mounted to said locking component, said link having one end pivotally connectable to said second end of said first lever and a second end pivotally connectable to the second end of said second lever; and connection means for connecting said second end of said first lever to said link at a first location, said first and said second levers being positioned such that movement of the lock arms of any two of said three locks from said locked position to said unlocked position causes said lock component to move from said first position to said second position when said connection means is at said first location.

3. A lock assembly as defined in claim 2 wherein said connection means includes means for connecting said second end of said first lever to said link at a second location, wherein movement from said locked position to said unlocked position of a specific two of said three locks, or a specific one of said three locks, causes said lock bar to move from said first position to said second position.

4. A lock assembly for use on a security door for locking and unlocking said security door, said lock assembly comprising:

a lock component movable a predetermined distance between a first position locking said door and a second position unlocking said door;

three spaced-apart locks, each of said locks having a lock arm movable a set distance between a locked position and an unlocked position;

a connector bar pivotally connecting the lock arms of a first lock and a second lock of said three locks;

a first lever pivotable about a first fixed axis, said first lever having a first end pivotally connected to said connector bar for movement therewith, and a second end movable about said first fixed axis in response to movement of said first end;

a second lever rotatable about a second fixed axis, said second lever having a first end pivotally connected to the lock arm of a third lock of said three locks for movement therewith and a second end movable in response to movement of said first end;

a link being pivotally mounted to said lock component, said link having one end pivotally connectable to said second end of said first lever and a second end pivotally connectable to the second end of said second lever; and connection means for connecting said second end of said first lever to said link at a first location, said first and said second levers being positioned such that movement of the lock arms of a specific two of said three locks, or a specific one of said three locks, causes said lock bar to move from said first position to said second position.

5. A lock assembly as defined in claim 4 wherein said connection means includes means for connecting said second end of said first lever to said link at a second location, wherein movement from said locked position to said unlocked position of any two of said three locks from said locked position to said unlocked position causes said lock bar to move from said first position to said second position when said connection means is at said first location.

* * * * *